US007780542B1

(12) United States Patent
Ross et al.

(10) Patent No.: US 7,780,542 B1
(45) Date of Patent: Aug. 24, 2010

(54) GOLF TRAINING DEVICE

(76) Inventors: Mark C. Ross, 922 Rolling Acres Rd., Suite 2, Lady Lake, FL (US) 32159; Philip K. Mathias, 1404 Meadow View Way, Lady Lake, FL (US) 32159

( * ) Notice: Subject to any disclaimer, the term of this patent is extended or adjusted under 35 U.S.C. 154(b) by 0 days.

(21) Appl. No.: 12/383,327

(22) Filed: Mar. 23, 2009

Related U.S. Application Data

(60) Provisional application No. 61/070,383, filed on Mar. 21, 2008.

(51) Int. Cl.
*A63B 69/36* (2006.01)

(52) U.S. Cl. ..... 473/226; 473/228; 473/409

(58) Field of Classification Search ..... 473/219, 473/223, 226, 228, 231–234, 238, 409
See application file for complete search history.

(56) References Cited

U.S. PATENT DOCUMENTS

| | | | | |
|---|---|---|---|---|
| 3,951,415 | A | 4/1976 | Stuart | |
| 4,167,268 | A | 9/1979 | Lorang | |
| 4,569,525 | A * | 2/1986 | Folger | 473/242 |
| 4,576,378 | A * | 3/1986 | Backus | 473/228 |
| 5,143,376 | A | 9/1992 | Johnson | |
| 5,158,297 | A | 10/1992 | Johnson | |
| 5,184,825 | A * | 2/1993 | Ruth | 473/228 |
| 5,310,188 | A | 5/1994 | Hernberg | |
| 5,441,273 | A | 8/1995 | Stormon | |
| 5,605,509 | A | 2/1997 | Gray | |
| 5,665,007 | A | 9/1997 | Tatum | |
| 6,447,401 | B1 | 9/2002 | Torkos | |
| 7,004,850 | B1 | 2/2006 | Hong | |
| 7,059,970 | B1 | 6/2006 | Hamburger | |
| 7,258,622 | B1 | 8/2007 | Gaviria | |

* cited by examiner

*Primary Examiner*—Nini Legesse
(74) *Attorney, Agent, or Firm*—Frijouf, Rust & Pyle, P.A.

(57) ABSTRACT

A golf training device and process are disclosed for assisting a golf player in aligning a golf club through an arcuate path for contacting a golf ball. The golf training device comprises a plate including a face side and a back side. The face side of the plate has a first color. The back side of the plate has a second color. An exterior edge of the plate has a third color. A coupler extends between the interior edge of the plate and the shaft of the golf club for securing the plate to the golf club. The third color alone is visible during the golf player swinging the golf club for producing a perpendicular alignment between the face surface of the golf club and the ball. The perpendicular alignment between the face surface of the golf club and the ball propels the ball in a straight trajectory.

20 Claims, 17 Drawing Sheets

GOLF TRAINING DEVICE

CROSS-REFERENCE TO RELATED APPLICATIONS

This application claims benefit of U.S. Patent Provisional application Ser. No. 61/070,383 filed Mar. 21, 2008. All subject matter set forth in provisional application Ser. No. 61/070,383 is hereby incorporated by reference into the present application as if fully set forth herein.

BACKGROUND OF THE INVENTION

1. Field of the Invention

This invention relates to a sport training device and more particularly to the golf training device for assisting a golf player in aligning a golf club through an arcuate path for contacting a golf ball.

2. Background of the Invention

The game of golf has a very lengthy history and continues to attract many golf players each year. The game of golf may be very beneficial to a golf player in that it promotes hand eye coordination, flexibility and cardiovascular fitness. In addition, the game of golf may improve the personal and or business relationship among the golf players.

Although the game of golf may appear to be easily performed, a novice may find that in reality the game of golf can be quite discouraging. Even an experienced golf player may find the game of golf to be problematic. The golf player strives to control the direction and distance of the golf ball upon contact with a head of a golf club. Since the contact area between the head of the golf club and the golf ball is relatively small and the distance between the head of the golf club and the golf player is relatively large, the golf player may find it difficult to control the head of the golf club through an arcuate path for correctly contacting the golf ball with the head of the golf club.

Various types of golf training devices have been proposed by the prior art for instructing the golf player to correctly align the head of the golf club with the golf ball for controlling both the direction and distance of the golf ball. The following U.S. Patents are examples of attempt of the prior art to solve these problems.

U.S. Pat. No. 3,951,415 to Stuart discloses a golf putter sighting device that includes a clamp that removably and adjustably engages the shaft of the putter with the clamp supporting a rigid outwardly extending body on which two laterally spaced sights are mounted. The clamp is adjusted on the shaft to a position where an imaginary line extending through the sights is normal to the striking face of the putter, and a substantial portion of the body between the sights is obstructed by the shaft when the user is in a putting position and looking down onto the shaft and head of the putter. When the sights are visible as equally spaced on opposite sides of the shaft, the striking face of the putter head is normally disposed to the direction of the swing of the putter head as the latter is used in putting a golf ball.

U.S. Pat. No. 4,167,268 to Lorang discloses an apparatus enabling a golfer to visually determine that he has the face of his putter normal to the target line and that he is stroking his putter along a straight line with the face of his putter at a right angle relative to the target line by visually indicating conformance thereto or deviation therefrom. A gauge is mounted on the shaft of the putter spaced above the club head. The gauge extends outwardly from the golfer and lies in his line of vision from his eye to the ball and the club head. The gauge is set on the shaft at the same angle as the putting face. The gauge has two like side members aligned on either side of the putter face and/or an additional central member aligned with the putter face. The golfer aligns the putter face at the ball between the side members and/or the central member in visual alignment. He maintains the visual alignment prior to and during his entire putting stroke. If alignment is maintained, he has stroked his club against the ball along a straight line and at a right angle to it. If the alignment is not maintained he has turned the shaft angularly, stroked on a curve, stroked on a non-target line, and/or a combination thereof.

U.S. Pat. No. 5,143,376 to Johnson discloses a golf club swinging guide adapted for use on a golf club having a shaft and a head with a striking face. The guide includes a mount having a clamp for connecting the mount to a golf club generally above the head of the club. There is a vane pivotally connected to the mount. The vane is freely pivotal and responsive to movement of air so the vane visibly aligns itself in the direction the golf club is swung.

U.S. Pat. No. 5,158,297 to Johnson discloses golf clubs that exhibit at least one marking indicia on the surface of the shaft and extending along at least one of the lateral sides of the shaft. The marking indicia is preferably a series of lines that are parallel to the edge of the shaft and separated by a distance sufficient to be revealed or hidden as the club face is opened or closed by small angular increments. Golf shafts according to the invention include: a shaft having a circular cross section and comprising (a) a tip end for attaching a club head to the shaft, (b) a butt end for attaching a grip to the shaft, and (c) at least one linearly oriented first alpha marking indicia positioned on the exterior of the shaft within an angle, .alpha., about 45.degree. to about 135.degree. from a clockwise position relative to top dead center of the shaft and extending up the shaft away from the tip end for a distance sufficient to allow a golfer to view the marking indicia and discern an angular position of the club face of up to about 15.degree. relative to a square alignment. The present invention provides a shaft having alignment indicia that are convenient and reproducibly used to produce a square, slice, or hook shot. Having the indicia located within the lower half of the shaft reduces the need to shift focal point when viewing the indicia thereby assisting the golfer in maintaining concentration when preparing for a shot. The view focus does not need to shift from the club head to an alignment device located on or next to the hand grip. A shaft with a circular cross section permits the use of a plurality of linearly extending indicia that can be positioned to provide a variety of reproducible shots of incremental amounts of hook or slice.

U.S. Pat. No. 5,310,188 to Hernberg discloses a device for providing visual feedback to the golf player of his grip during his golf stroke in maintaining proper alignment of the golf club face and the golf ball while increasing the air resistance the player encounters during the golf stroke. The device comprises a finned member for securement to the shaft of a conventional golf club adjacent the head. Certain of the fins include surfaces having visually perceptible indicia thereon, e.g., colors. The device is arranged so that one of the fins is oriented in a direction whereupon certain indicia are not visible if the club head is in a desired orientation, but will be visible if the club head is in another orientation, e.g., open or closed. The fins provide wind resistance during the swing. A weight may be secured to one of the fins.

U.S. Pat. No. 5,441,273 to Stormon discloses a putter fitting tool and stroke analyzer, called the "fitting tool", is to custom fit a golf club putter to match the composite physical stature and preferred stroking posture of an individual golfer. The tool's lie angle indicator marks when aligned between the eyes and putterhead sight or ball striking point, makes a 90 degree sight plane to the target called "sight plane". The putter is adjusted in manufacturing to match the sight plane specified by the tool. The preferred sight of the system is specially constructed to duplicate the desired sight plane once the tool is removed. This allows the golfer to putt from the same stroking position every time. The sight plane indicator marks or lie angle marks of the tool allow the golfer to try-a variety of sight planes to select the one most suited to his putting posture. The tool, as a stroke analyzer, magnifies deviations from the sight plane (the "sight plane" is the plane which intersects the clubhead, target, and golfer's eye) during the stroke. The tool has additional marks to indicate the adjustment the manufacturer uses to compensate for a putter sight location difference between the putter used for fitting and the putter the consumer is ordering. The fitting tool consists of the following: a rod with lie angle or sight plane indicator marks, a finger nut, a flange nut, and a loop clamp.

U.S. Pat. No. 5,605,509 to Gray discloses a training/playing aid for clamping on the shaft of a golf club for use in the measurement of movement in degrees that a golfer comes over the top of the ball at impact. Upon measurement of this movement, the training/playing aid is adjusted making it possible to position the golfer in a correct golf ball addressing stance. The training/playing aid comprises an elongated arm having a clamp at one end for securing the arm to the shaft of the golf club to extend laterally thereof. The clamp comprises a cylindrical shell having an opening at one side for clamping on the shaft of the golf club. The arm is streamlined with a streamlined pointer movably mounted on the arm of the golf club in a direction parallel with the head of the club with the pointer aligned with the "sweet spot" of the golf club.

U.S. Pat. No. 5,665,007 to Tatum discloses a golf putting training device attached to the shaft of a putter having a shape that extends out from the shaft and forms an elongated edge that is aligned by a user along the heel of the putter so that a spacing is formed between the edge and a golf ball adjacent the putter head face at address. The user moves the putter head along the putting stroke so that the spacing is maintained essential constant throughout the stroke thereby ensuring the putter head face is maintained perpendicular to the target line during the putting stroke.

U.S. Pat. No. 6,447,401 to Torkos discloses a golf club alignment device to be secured to an outer surface of a golf club shaft. The device comprises a band of material having first and second markings positioned at first and second ends of a central portion, the markings being of contrasting visual appearance relative to the central portion of the band, with the markings preferably being light in colour and the central portion of the band preferably being dark in colour. The contrasting visual appearance of the markings and the central portion create visual transition points between the markings and the central portion of the band. The transition points between the markings and the central portion of the band are spaced apart by a distance such that, when the band is applied to the cylindrical surface of the golf club shaft with the center point of the central portion coincident with the rearmost point of the shaft, the transition points are located at 180 degrees to one another and at 90 degrees to the rearmost point on the shaft. When the device is installed on the golf club shaft, the central portion of the band extends about the rear face of the shaft, while the contrasting markings wrap around the front face of the shaft. The golfer aligns the club by sighting down along the front face of the shaft and rotating the club until both of the outer markings are visible while no part of the central portion is visible to ensure that the striking face of the golf club is properly aligned relative to the intended path of ball travel.

U.S. Pat. No. 7,004,850 to Hong discloses a training golf club helping a golfer become aware of the direction and angle of their swing and adjust their stance, the angle at which they are holding their club and the direction of their swing or putter when practicing. The golf club has a club-shaft, a club-grip, and a club-head. An improvement includes an assistant plate being fixed onto the club-shaft. The assistant plate is parallel to the ball striking face of the club-head. The assistant plate has a horizontal bottom edge, and the horizontal bottom edge and a bottom edge of the club-head is preferably located along a same plane.

U.S. Pat. No. 7,059,970 to Hamburger discloses a golf club alignment device for aiding a user in striking a golf ball with a golf club having a head, shaft and handle. The alignment device includes a body having first and second ends. A clamp portion extends from the first end of the body and is adapted for resilient and removable attachment to the shaft of the golf club. The device further includes a sighting structure extending from the second end of the body. The sighting structure is configured having a width less than the diameter of the shaft.

U.S. Pat. No. 7,258,622 to Gaviria discloses a training aid for monitoring and improving the orientation a golfer's hands while gripping the golf club as well as the golf club itself during the swing thereof, wherein the structure of the training aid is such as to allow it to be removably attached to the golf club and travel therewith during the swing without interfering with the normal path of the golf club during such swing. A base assembly comprises a housing removably connected to the club shaft and a reference assembly movably interconnected to the housing and positionable into an operative position. The reference assembly includes one or more legs disposable radially outward from the housing and into frontal alignment with a longitudinal axis of the golf club when in the operative position such that the one leg and/or an indicator structure thereon is readily observable as the club travels along the swing path.

Although the aforementioned prior art have contributed to the development of the art of golf training devices, none of these prior art patents have solved the needs of this art.

Therefore, it is an object of the present invention to provide an improved golf training device for assisting a golf player in aligning a golf club through an arcuate path contacting a golf ball.

Another object of this invention is to provide an improved golf training device that may be positioned upon one or more golf clubs.

Another object of this invention is to provide an improved golf training device that may be easily installed and removed from a golf club without damaging either the golf training device or the golf club.

Another object of this invention is to provide an improved golf training device that may assist the golf player to align the golf club for a plurality of golf shots.

Another object of this invention is to provide an improved golf training device that may assist a golf trainer for instructing a golf player to align a golf club through an arcuate path for contacting a golf ball.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention an relates to a golf training device for assisting a golf player in aligning a golf club through an arcuate path for contacting a golf ball. The golf club has a shaft interposed between a head and a grip. The head has a face surface for contacting the golf ball. The golf training device comprises a plate including a face side and a back side. The plate has a thickness for defining an interior edge and an exterior edge. The face side of the plate has a first color. The back side of the plate has a second color. The exterior edge of the plate has a third color. A coupler extends between the interior edge of the plate and the shaft of the golf club for securing the plate to the golf club. The plate is aligned parallel to the face surface of the golf club. The third color is visible during the golf player swinging the golf club through the arcuate path for producing a perpendicular alignment between the face surface of the golf club and the ball. The first color and the second color are not visible during the golf player swinging the golf club through the arcuate path for producing the perpendicular alignment between the face surface of the golf club and the ball. The perpendicular alignment between the face surface of the golf club and the ball propels the ball in a straight trajectory.

In a more specific embodiment of the invention, the interior edge of the plate defines an interior trapezoid base having an interior base length. The exterior edge of the plate defines an exterior trapezoid base having an exterior base length. The interior trapezoid base and the exterior trapezoid base are in a parallel orientation. The plate defines an upper trapezoid leg having an upper leg length. The plate defines a lower trapezoid leg having a lower leg length. The upper trapezoid leg and the lower leg trapezoid are in a non-parallel orientation. The interior trapezoid base, the exterior trapezoid base, the upper trapezoid leg and the lower trapezoid leg defines a trapezoid shape. The interior trapezoid base and the upper trapezoid leg define an upper acute angle. The interior trapezoid base and the lower leg trapezoid define a lower acute angle. The upper acute angle is greater than the lower acute angle and the interior base length is greater than the exterior base length for positioning the upper trapezoid leg in a more horizontal orientation than the lower trapezoid leg. The upper trapezoid leg includes the third color. The first color includes yellow, the second color includes green and the third color includes red.

In a more specific embodiment of the invention, the coupler includes an upper clip and a lower clip. The upper clip has a shaft clamp oppositely opposing a plate clamp. The shaft clamp includes a first arm and a second arm for defining an upper shaft chamber. The first arm and the second arm of the upper clip yield for positioning the shaft into upper shaft chamber. The plate clamp includes a primary arm and a secondary arm for defining an upper plate chamber. The primary arm and secondary arm of the upper clip yield for positioning the plate into upper plate chamber. The lower clip has a shaft clamp oppositely opposing a plate clamp. The shaft clamp includes a first arm and a second arm for defining a lower shaft chamber. The first arm and the second arm of the lower clip yield for positioning the shaft into lower shaft chamber. The plate clamp includes a primary arm and a secondary arm for defining a lower plate chamber. The primary arm and secondary arm of the lower clip yield for positioning the plate into lower plate chamber.

In another embodiment of the invention, the golf training device assists a golf trainer in instructing a golf player to align a golf club through an arcuate path for contacting a golf ball. The golf trainer aligns in a face to face orientation with the golf player. The third color is visible to the golf trainer with the golf club in a vertical position of the arcuate path for producing a perpendicular alignment between the face surface of the golf club and the ball. The first color and the second color are not visible to the golf trainer with the golf club in the vertical position of the arcuate path for producing the perpendicular alignment between the face surface of the golf club and the ball. The perpendicular alignment between the face surface of the golf club and the ball propel the ball in a straight trajectory.

The invention is also incorporated into the method of training a golf player in aligning a golf club through an arcuate path for contacting a golf ball. The process comprising the steps of aligning the plate for viewing the third color during the golf player swinging the golf club through the arcuate path for producing a perpendicular alignment between the face surface of the golf club and the golf ball. Aligning the plate for not viewing the first color and the second color during the golf player swinging the golf club through the arcuate path for producing the perpendicular alignment between the face surface of the golf club and the golf ball. Striking the golf ball with the face surface of the golf club with the perpendicular alignment between the face surface of the golf club and the ball for propelling the ball in a straight trajectory.

In another embodiment of the invention, the method includes a golf trainer assisting a golf player in aligning a golf club through an arcuate path for contacting a golf ball. The process comprises the steps of aligning the plate for viewing the third color by the golf trainer during the golf club in a vertical position of the arcuate path for producing a perpendicular alignment between the face surface of the golf club and the ball. Aligning the plate for not viewing the first color and the second color by the golf trainer during the golf club in the vertical position of the arcuate path for producing the perpendicular alignment between the face surface of the golf club and the golf ball. Striking the golf ball with the face surface of the golf club with the perpendicular alignment between the face surface of the golf club and the ball for propelling the ball in a straight trajectory.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 29 is a front view similar to FIG. 28 illustrating a first position of a follow through;

FIG. 30 is a front view similar to FIG. 29 illustrating a mid-point of the follow through;

FIG. 34 is a view similar to FIG. 32 illustrating the first position of the follow through;

FIG. 37 is a view similar to FIG. 35 illustrating the first position of the follow through;

FIG. 40 is a view similar to FIG. 38 illustrating the first position of the follow through;

FIG. 43 is a view similar to FIG. 41 illustrating the first position of the follow through;

FIG. 46 a is a view similar to FIG. 44 illustrating the first position of the follow through.

Similar reference characters refer to similar parts throughout the several Figures of the drawings.

DETAILED DISCUSSION

Figure 1:
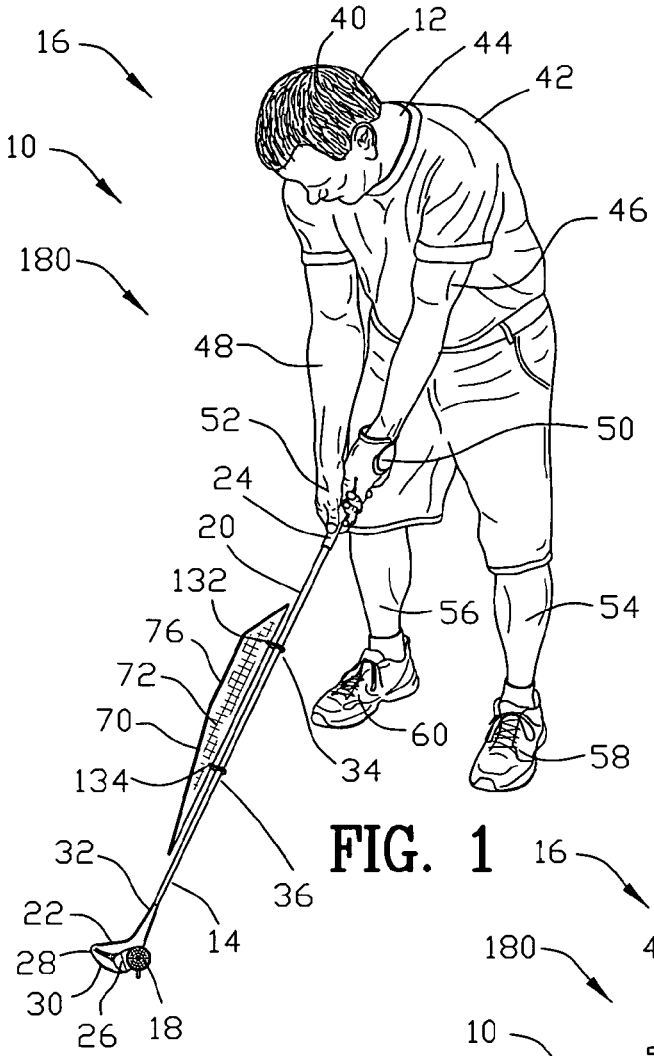
FIG. 1 is an isometric view of a golf training device of the present invention.
Figure 2:
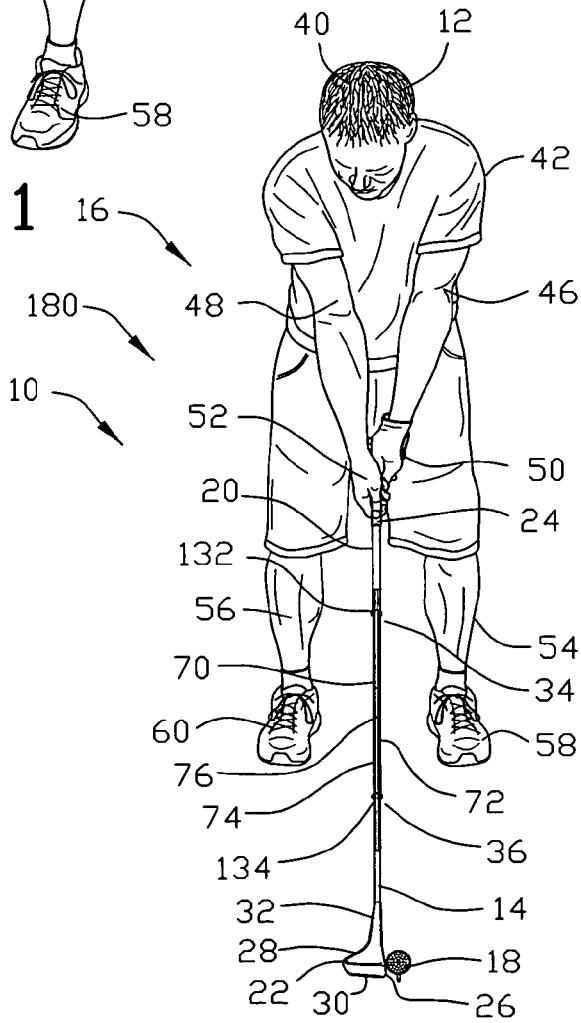
FIG. 2 is a front view of FIG. 1.
Figure 3:
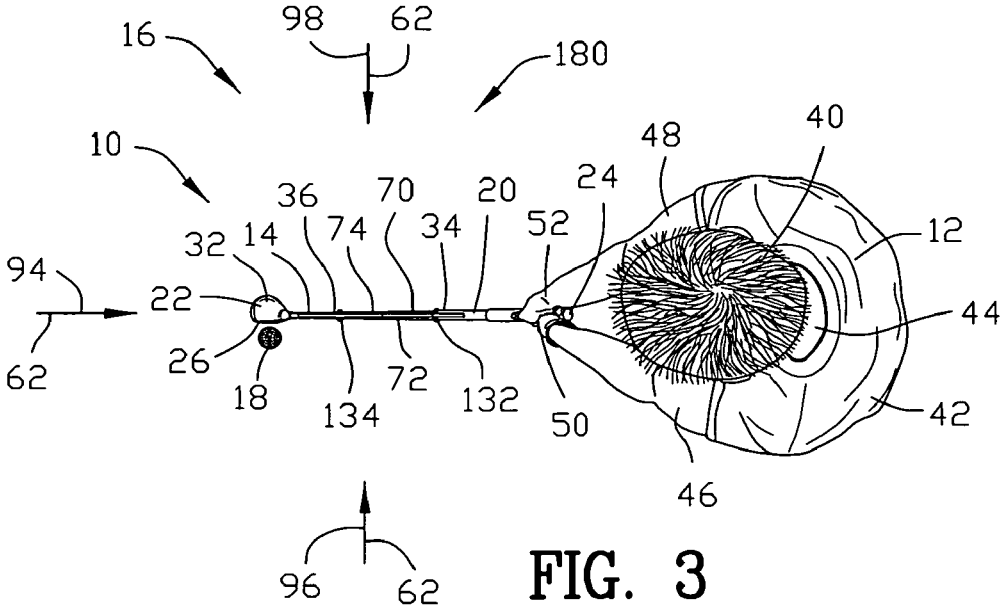
FIG. 3 is a top view of FIG. 2.
Figure 4:
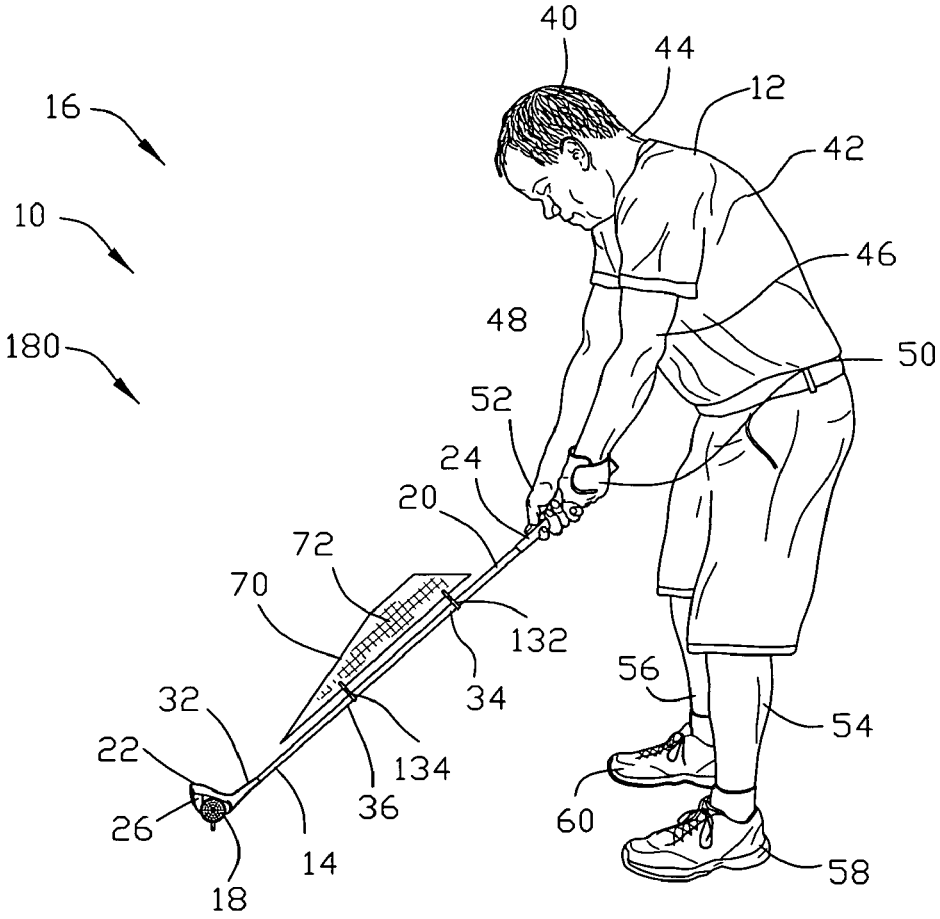
FIG. 4 is a side view of FIG. 2.
Figure 5:
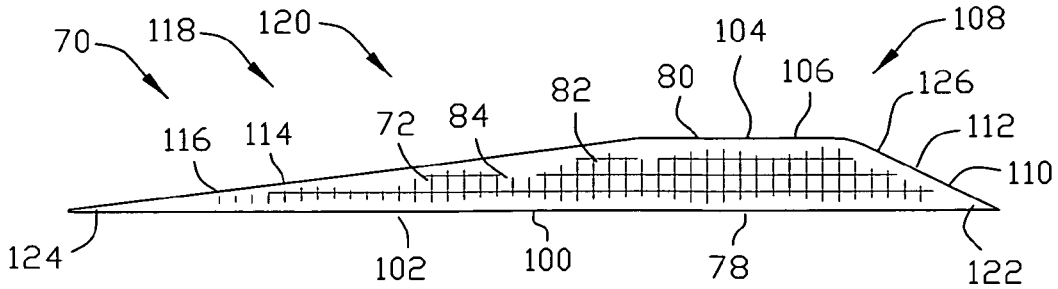
FIG. 5 is a front side view of a plate of FIG. 1.
Figure 6:
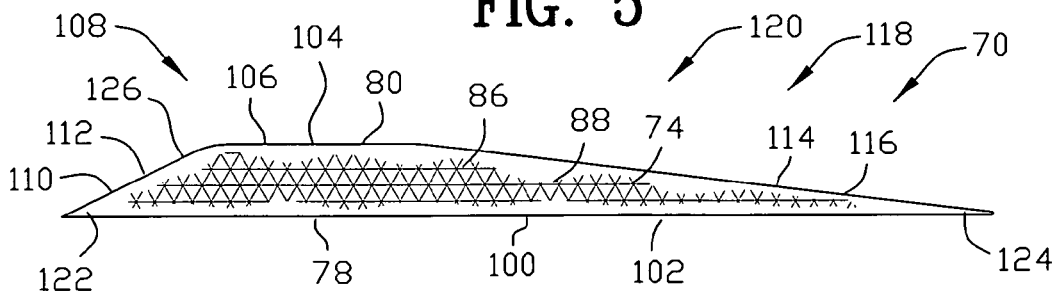
FIG. 6 is a rear side view of the plate of FIG. 1.
Figure 7:
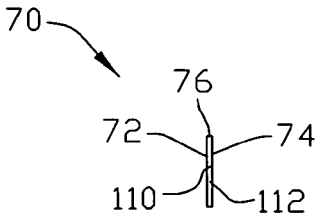
FIG. 7 is a top view of FIG. 5.
Figure 8:
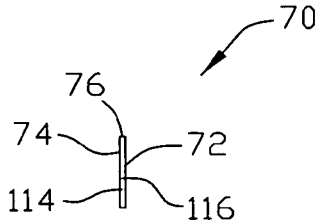
FIG. 8 is a bottom view of FIG. 5.
Figure 9:
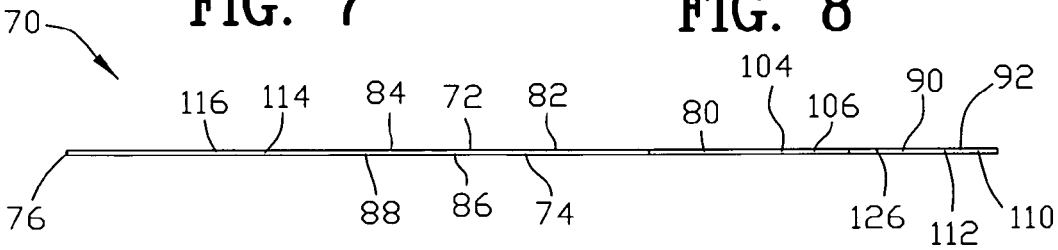
FIG. 9 is a top view of FIG. 5.
Figure 10:
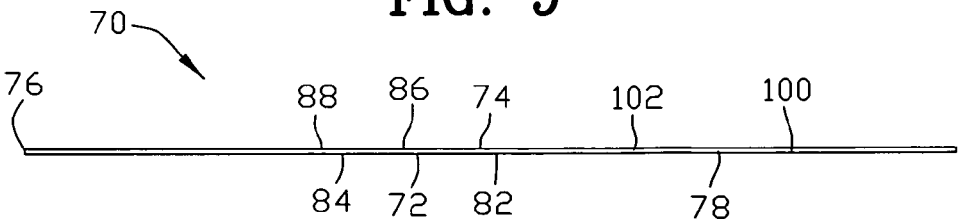
FIG. 10 is a bottom view of FIG. 5.
Figure 11:
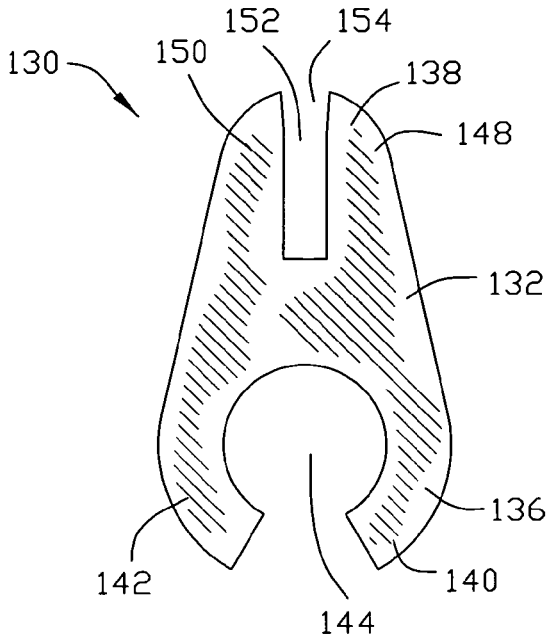
FIG. 11 is a top view of an upper clip of FIG. 1.
Figure 12:
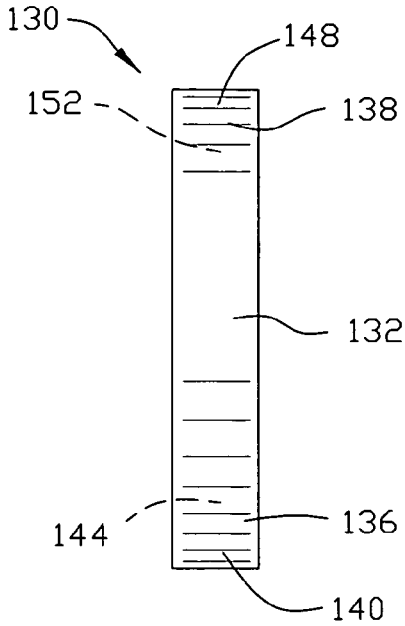
FIG. 12 is a side view of FIG. 11.
Figure 13:
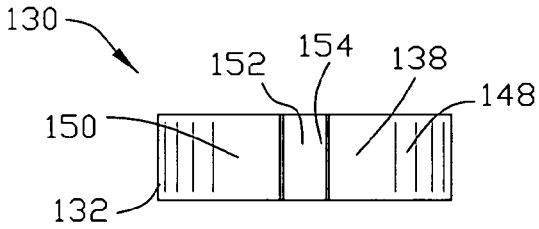
FIG. 13 is a top view of FIG. 11.
Figure 14:
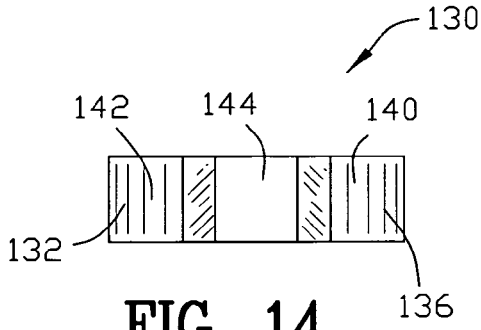
FIG. 14 is a bottom view of FIG. 11.
Figure 15:
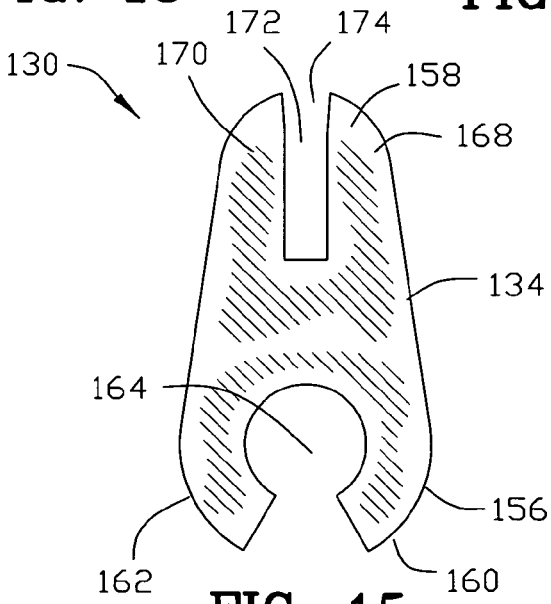
FIG. 15 is a top view of a lower clip of FIG. 1.
Figure 16:
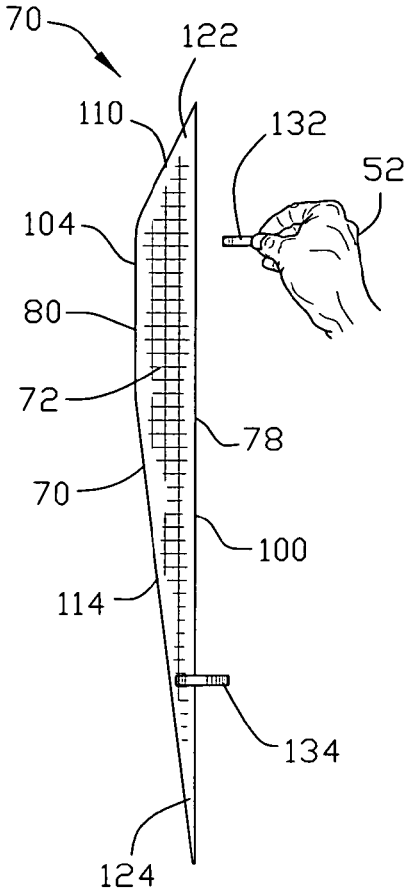
FIG. 16 is a front side view similar to FIG. 5 illustrating the upper clip and the lower clip engaging the plate.
Figure 17:
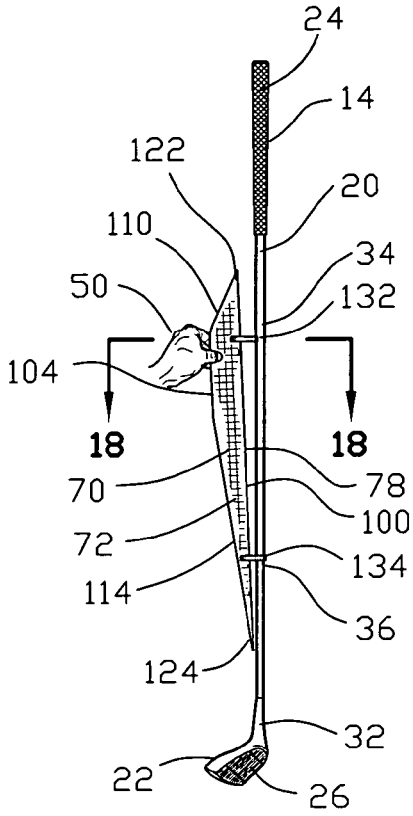
FIG. 17 is a front side view similar to FIG. 16 illustrating the upper clip and the lower clip engaging a golf club.
Figure 18:
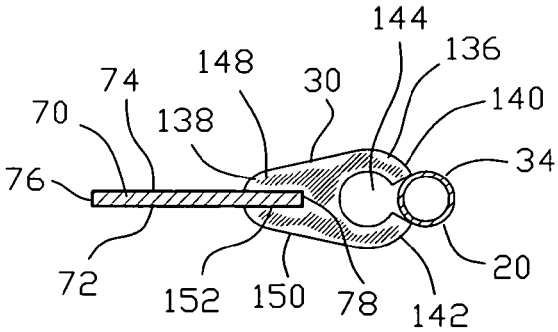
FIG. 18 is a sectional view along line 18-18 in FIG. 17.
Figure 19:
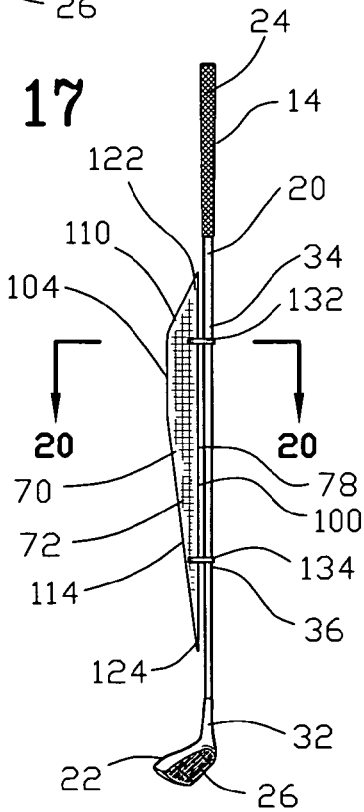
FIG. 19 is a front side view similar to FIG. 17 illustrating the upper clip and the lower clip secured to the golf club.
Figure 20:
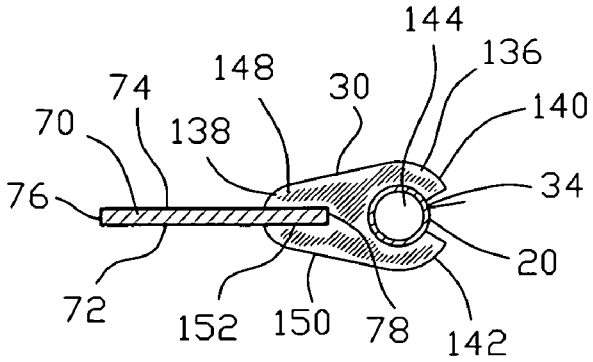
FIG. 20 is a enlarged top view of FIG. 19.

FIGS. 1-46 are various views of a golf training device 10 for assisting a golf player 12 in aligning a golf club 14 through an arcuate path 16 for contacting a golf ball 18. The golf club 14 has a shaft 20 interposed between a head 22 and a grip 24. The head 22 has a face surface 26 for contacting the golf ball 18. The golf club 14 is shown to include an iron golf club 28, however the golf club 14 may further include a putter golf club 30 or a wood golf club 32.

The golf player 12 is shown having a head 40 secured to a body 42 by a neck 44. A first arm 46 and a second arm 48 extending from the body 42. The first arm 46 and the second arm 48 include a first hand 50 and a second hand 52, respectively. A first leg 54 and a second leg 56 also extend from the body 42. The first leg 54 and the second leg 56 include a first foot 58 and a second foot 60, respectively.

As best seen in FIGS. 1-22, the golf training device 10 includes a plate 70 including a face side 72 and a back side 74. The plate 70 has a thickness 76 for defining an interior edge 78 and an exterior edge 80. The plate 70 may be constructed from a polymeric, metallic or other rigid material. The face side 72 of the plate 70 has a first color 82. The first color 82 may include a yellow color, however may comprise other colors. The back side 74 of the plate 70 has a second color 86. The second color 86 may include a green color 88, however may comprise other colors. The exterior edge 80 of the plate 70 has a third color 90. The third color 90 may include a red color 92, however may comprise all their colors.

As best seen in FIGS. 5-10, the interior edge 78 of the plate 70 defines an interior trapezoid base 100 having an interior base length 102. The exterior edge 80 of the plate 70 defines an exterior trapezoid base 104 having an exterior base length 106. The interior trapezoid base 100 and the exterior trapezoid base 104 are in a parallel orientation 108. The plate 70 further defines an upper trapezoid leg 110 having an upper leg length 112. The plate 70 includes a lower trapezoid leg 114 having a lower leg length 116. The upper trapezoid leg 110 and the lower leg trapezoid 114 are in a non-parallel orientation 118. The interior trapezoid base 100, the exterior trapezoid base 104, the upper trapezoid leg 110 and the lower trapezoid leg 114 define a trapezoid shape 120.

The interior trapezoid base 100 and the upper trapezoid leg 110 define an upper acute angle 122. The interior trapezoid base 100 and the lower leg trapezoid 114 define a lower acute angle 124. The upper acute angle 122 is greater than the lower acute angle 124 and the interior base length 102 is greater than the exterior base length 106 for positioning the upper trapezoid leg 110 in a more horizontal orientation 126 than the lower trapezoid leg 114. Preferably, the upper trapezoid leg 110 includes the third color 90.

As best seen in FIGS. 11-22, a coupler 130 extends between the interior edge 78 of the plate 70 and the shaft 20 of the golf club 14 for securing the plate 70 to the golf club 14. The coupler 130 may include an upper clip 132 and a lower clip 134. The upper clip 132 has a shaft clamp 136 oppositely opposing a plate clamp 138. The shaft clamp 136 of the upper clip 132 including a first arm 140 and a second arm 142 for defining an upper shaft chamber 144. The upper shaft chamber 144 defines an upper shaft area 146. The first arm 140 and the second arm 142 of the upper clip 132 yield or deform for increasing the distance between the first arm 140 and the second arm 142 upon the shaft 20 being depressed with the upper shaft chamber 144 for positioning the shaft 20 into the upper shaft chamber 144. Preferably, the upper shaft area 146 of the upper shaft chamber 144 while not engaged with the shaft 20 is less than the upper club shaft area 34 of the shaft 24 for providing a snug fit upon engagement between the shaft clamp 136 of the upper clip 132 and the shaft 20.

The plate clamp 138 of the upper clip 132 includes a primary arm 148 and a secondary arm 150 for defining an upper plate chamber 152. The upper plate chamber 152 defines an upper plate thickness 154. The primary arm 148 and the secondary arm 150 of the upper clip 132 yield or deform for increasing the distance between the first primary arm 148 and the secondary arm 150 upon the interior edge 78 of the plate 70 being depressed with the upper plate chamber 152 for positioning the plate 70 into the upper plate chamber 152. Preferably, the upper plate thickness 154 of the upper plate chamber 152 while not engaged with the plate 70 is less than the thickness 76 of the plate 70 for providing a snug fit upon engagement between the plate clamp 138 of the upper clip 132 and the plate 70.

The lower clip 134 has a shaft clamp 156 oppositely opposing a plate clamp 158. The shaft clamp 156 of the lower clip 134 includes a first arm 160 and a second arm 162 for defining a lower shaft chamber 164. The lower shaft chamber 164 defines a lower shaft area 166. The first arm 160 and the second arm 162 of the lower clip 134 yielding or deform for increasing the distance between the first arm 160 and the second arm 162 upon the shaft 20 being depressed with the lower shaft chamber 164 for positioning the shaft 20 into the lower shaft chamber 164. Preferably, the lower shaft area 166 of the lower shaft chamber 164, while not engaged with the shaft 20 is less than the lower club shaft area 36 of the shaft 24 for providing a snug fit upon engagement between the shaft clamp 156 of the lower clip 134 and the shaft 20.

The plate clamp 158 of the lower clip 134 including a primary arm 168 and a secondary arm 170 for defining a lower plate chamber 172. The lower plate chamber 172 defines a lower plate thickness 174. The primary arm 168 and the secondary arm 170 of the lower clip 134 yield or deform for increasing the distance between the first primary arm 168 and the secondary arm 170 upon the interior edge 78 of the plate 70 being depressed with the lower plate chamber 172 for positioning the plate 70 into the lower plate chamber 172. Preferably, the lower plate thickness 174 of the lower plate chamber 172, while not engage with the plate 70 is less than the thickness 76 of the plate 70 for providing a snug fit upon engagement between the plate clamp 158 of the lower clip 134 and the plate 70. Both the upper clip 132 and the lower clip 134 may be constructed from a polymeric, metallic or other rigid material. Since the shaft 20 includes a tapering diameter, the upper clip 132 is preferably proportionally larger then the lower clip 134.

FIGS. 16-22 illustrate the plate 70 being attached to the golf club 40. The lower clip 134 is secured to the plate 70 by inserting the interior edge 78 of the plate 70 into the lower plate chamber 172. Similarly, the upper clip 132 is secured to the plate 70 by inserting the interior edge 78 of the plate 70 into the upper plate chamber 152. Preferably the lower clip 134 and the upper clip 132 may be distanced between 8 to 10 inches from each other.

The plate 70 is aligned with the shaft 20 of the golf club 18 such that the lower acute angle 124 is positioned adjacent to the head 22 and the upper acute angle 122 is positioned adjacent to the grip 24. With this orientation between the shaft 20 and the plate 70, the face side 72 of the plate 70 is facing the same direction as the face surface 26 of the head 22.

The lower clip 134 is secured to the golf club 14 by inserting the shaft 20 into the shaft clamp 156 of the lower clip 134. Similarly, the upper clip 132 is secured to the golf club 14 by inserting the shaft 20 in the shaft clamp 136 of the upper clip 132. Since the shaft 20 includes a tapering diameter, the location of the upper clip 132 and the lower clip 134 relative to the shaft 20 may require adjustment in order to provide a snug fit between shaft 20 with both the shaft clamp 136 of the upper clip 132 and the shaft clamp 156 of the lower clip 134.

Figure 21:
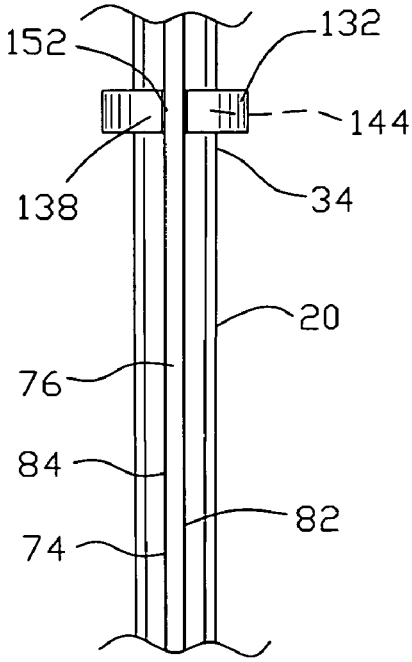
FIG. 21 is a sectional view along line 21-21 in FIG. 19.
Figure 21:
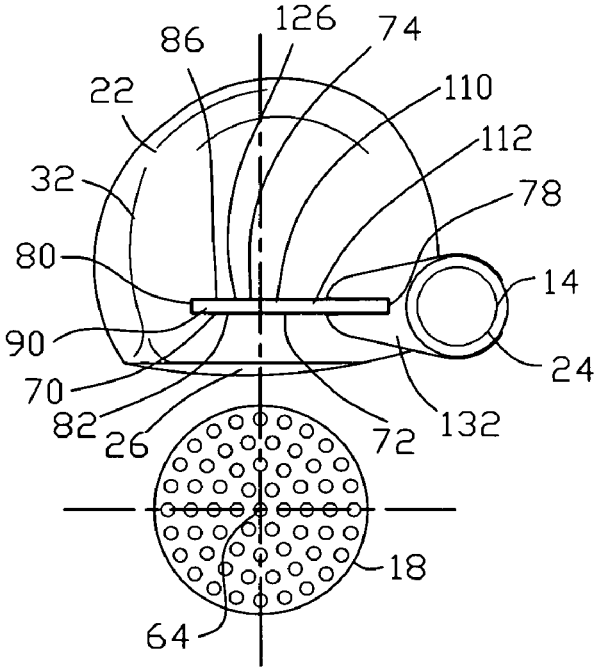
Figure 22:
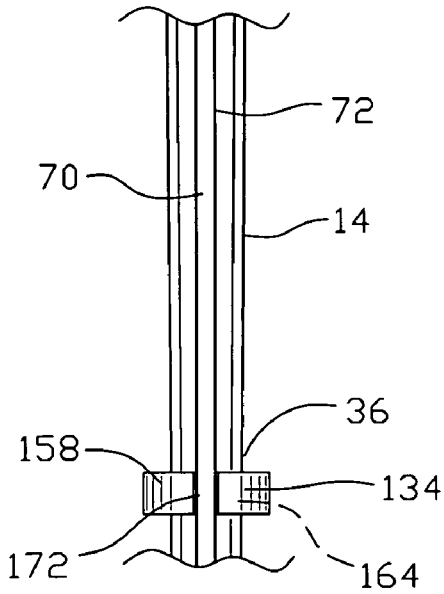
FIG. 22 is an enlarged view of a portion of FIG. 2.

As best seen in FIG. 21, the plate 70 is then aligned with the face surface 26 of the head 22. Preferably, the head 22 is placed on the level surface adjacent to a golf ball 18. The face surface 22 is squared to the golf ball 18 by aligning the central axis 64 of the golf ball 18 perpendicular to the face surface 26 of the head 22. While retaining the perpendicular orientation between the face surface 26 and the golf ball 18, the plate 70 is rotated upon the shaft 20 until the face side 72 is parallel to the face surface 26.

The golf training device 10 provides visualization of the alignment of the face surface 26 relative to the golf ball 18. As will be seen in more detail, the golf training device 10 provides a visualization of a perpendicular alignment between the face surface 26 and the golf ball 18. Furthermore, the golf training device 10 provides a visualization of an angular alignment between the face surface 26 and the golf ball 18. As the golf player 12 utilizes the golf training device 10 for aligning the face surface 26 through an arcuate path for contacting the golf ball 18, the golf player 12 will develop a muscular memory of that particular arcuate path. The muscular memory will provide the golf player 12 the ability to reproduce an arcuate path without the utilization of the golf training device 10.

As best seen in FIGS. 1-4, 23-34 and 47, the golf training device 10 assists the golf player 12 in aligning a golf club 14 through an arcuate path 16 for contacting a golf ball 18. More specifically, the golf training device 10 assists the golf player 12 in positioning the golf club 14 along the arcuate path 16 in order make contact between the face surface 26 of the golf club 14 and the golf ball 18 with a perpendicular alignment 180. If the golf player 12 is able to establish the perpendicular alignment 180 upon contact between the face surface 26 of the golf club 14 and the golf ball 18, the golf ball 18 will be propelled in a straight trajectory.

FIGS. 23 thru 31 and 47 illustrate various positions of the golf player 12 swinging a golf club 14 through the arcuate path 16 for producing the perpendicular alignment 180 between the face surface 26 of the golf club 14 and the golf ball 18. In addition, to the golf training device 10 assisting the golf player 12 in aligning the golf club 14 through the arcuate path 12, the golf training device 10 may also be utilized by a golf trainer 62, who is positioned adjacent to the golf player 12. More specifically, the golf trainer 62 may be positioned in a face-to-face orientation 94 with the golf player 12, in a front side orientation 96 with the golf player 12 or a rear side orientation 98 with the golf player 12. The golf training device 10 permits the golf trainer 62 to view the plate 70 to determine the alignment of the golf club 14 through the arcuate path 16 for contacting the golf ball 18. The golf trainer 62 would then be able to recommend altering the performance of the golf player 12 if the arcuate path 16 was not correct.

Figure 23:
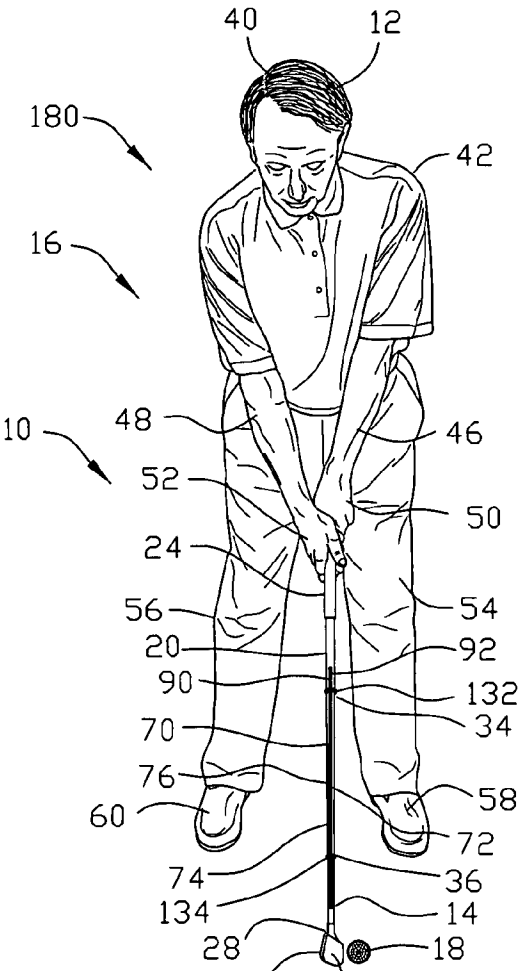
FIG. 23 is a front view similar to FIG. 1 illustrating the golf player in a starting position.
Figure 32:
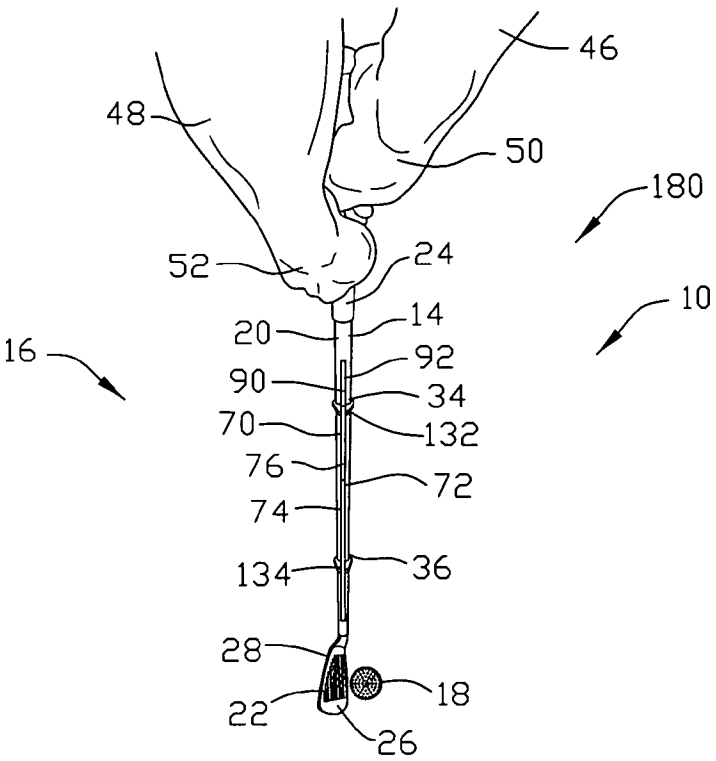
FIG. 32 is an enlarged view of FIG. 3 illustrating the starting position.
Figure 47:
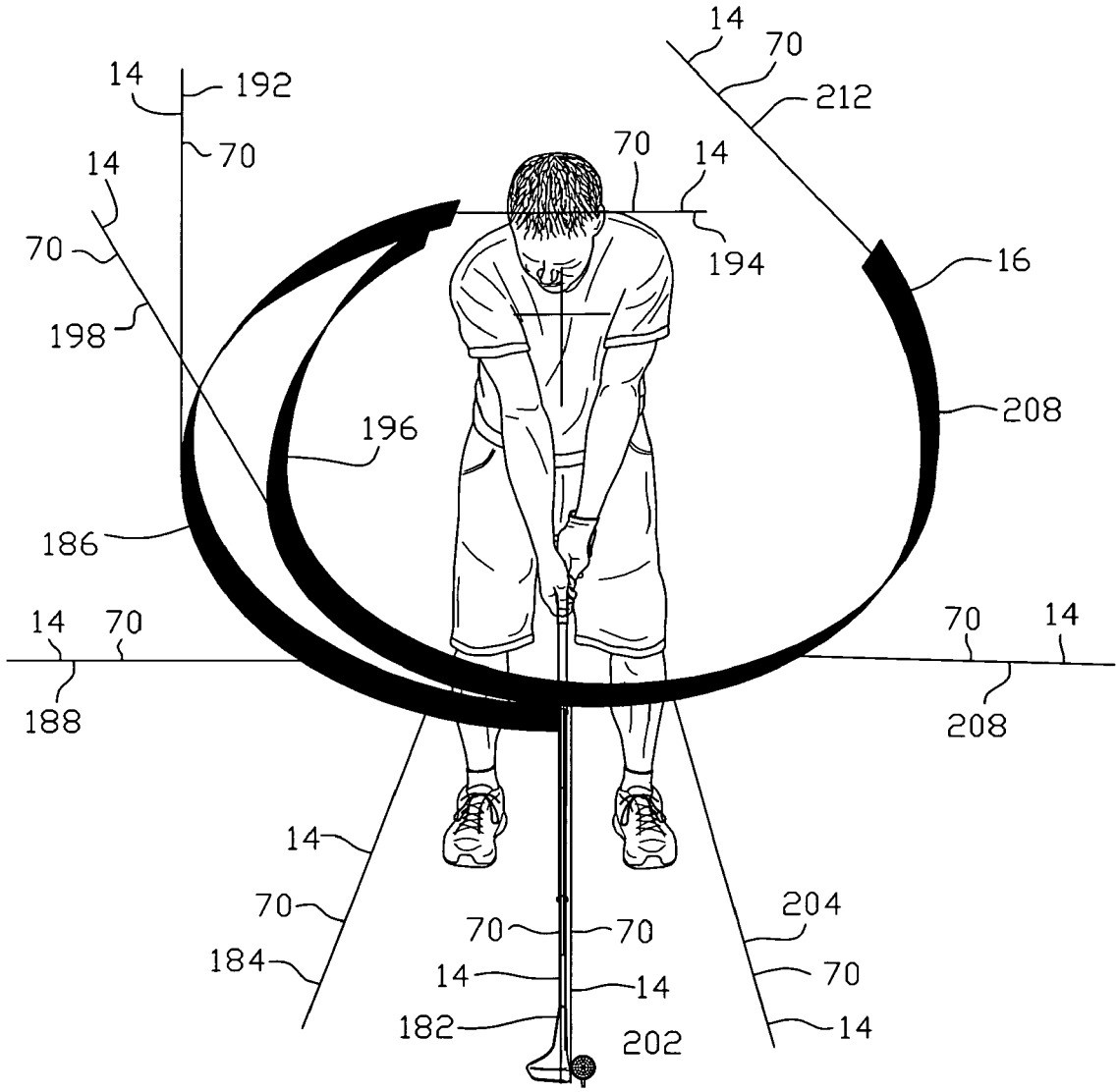
FIG. 47 is a view similar to FIG. 2 incorporating an arcuate path.

FIGS. 23, 32 and 47 illustrate a starting position 182 of the arcuate path 16. Once the golf player 12 has correctly postured the body 42 and the head 40 and has gripped the grip 24 with the first and 50 and the secondhand 52, the golf player 12 proceeds to adjust the position of the head 22 until the golf player 12 is only able to view the third color 90 or red color 92 of the exterior edge 80. Once the golf player 12 has acquired view of only the third color 90, without viewing the first color 82, yellow color 84 or the second color 86, green color 88, the face surface 26 will be positioned in the perpendicular alignment 180 with the golf ball 18. The golf trainer 62 may also utilized the golf training device 10 for instructing the golf player 12 for positioning the face surface 26 in the perpendicular alignment 180 with the golf ball 18 at the starting position 182.

Plate Views for Starting Position (Perpendicular Alignment)

Player:

Third color 90 or red color 92;

No vision of first color 82, yellow color 84 or the second color 86, green color 88.

Trainer Face-to-Face:

Third color 90 or red color 92;

No vision of first color 82, yellow color 84 or the second color 86, green color 88.

Trainer Front Side:

First color 82 or yellow color 84;

No vision of second color 86, green color 88 or third color 90, red color 92.

Trainer Rear Side:

Second color 86 or green color 88;

No vision of first color 82, yellow color 84 or third color 90, red color 92.

Troubleshooting/Corrections:

Assure proper grip, alignment and posture;

Align the plate 70 square to the face surface 26 with only the exterior edge 80 showing.

Figure 33:
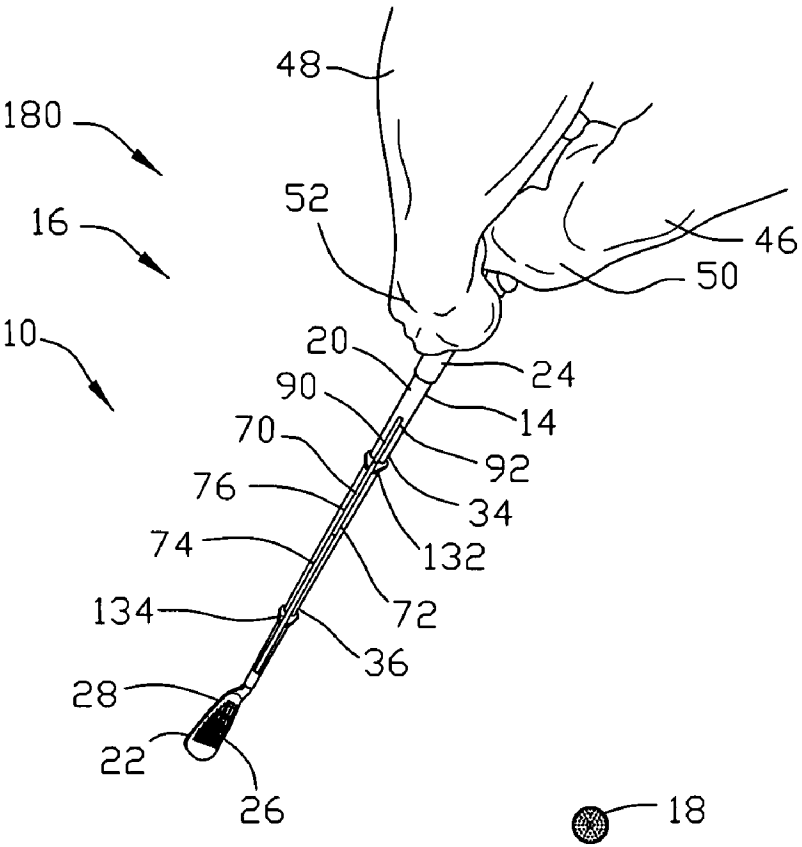
FIG. 33 is a view similar to FIG. 32 illustrating a takeaway point of the back swing.

FIGS. 33 and 47 illustrate the golf club 14 positioned to a waggle 184 position. The golf player 12 may wish to position the golf club to a waggle 184 position as a pre-shot routine prior to initiating a backswing 186. During the waggle 184 the golf player 12 should only be able to view the third color 90 of the exterior edge 80. In addition, the golf player 12 should not be able to view the first color 82 or the second color 86. By performing the waggle 184 with only the third color 90 exposed to the golf player 12 assures the face surface 26 will be positioned in the perpendicular alignment 180 with the golf club 18 at the starting position 182. The golf trainer 62 may also utilized the golf training device 10 for instructing the golf player 12 for positioning the face surface 26 in the perpendicular alignment 180 with the golf ball 18 at the waggle position 184.

Plate Views for Waggle Position (Perpendicular Alignment)

Player:

Third color 90 or red color 92;

None or minimal vision of first color 82, yellow color 84 or the second color 86, green color 88.

Trainer Face-to-Face:

Third color 90 or red color 92;

None or minimal vision of first color 82, yellow color 84 or the second color 86, green color 88.

Trainer Front Side:

Less than full view of first color 82 or yellow color 84;

No vision of second color 86, green color 88 or third color 90, red color 92.

Trainer Rear Side:

Less than full view of second color 86 or green color 88;

No vision of first color 82, yellow color 84 or third color 90, red color 92.

Troubleshooting/Corrections:

Tension and/or stress in the grip and forearms

Inside move or open face surface 26, the yellow color 84 will show

Outside move or closed face surface 26, the green color 88 will show

Assure proper grip

Relaxation in the forearms and grip

Slow (one piece) take away

Maintain the "Y" position between the arms

Figure 24:
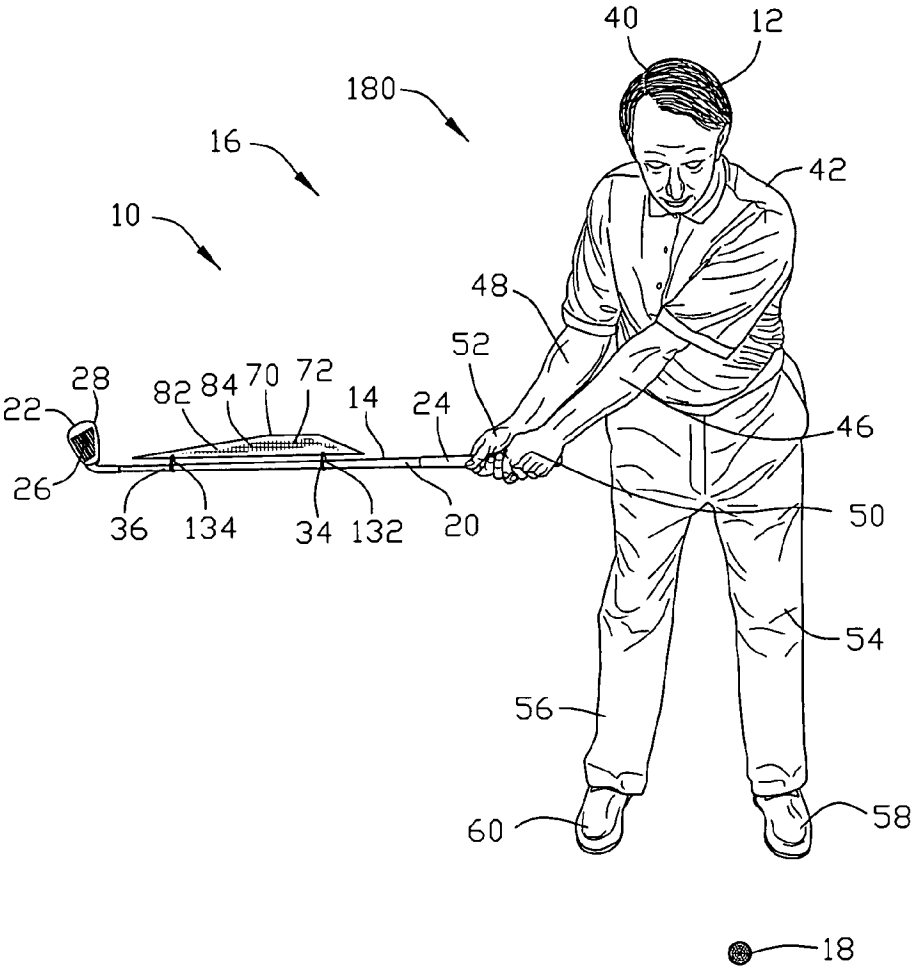
FIG. 24 is a front view similar to FIG. 23 illustrating a mid-point of a back swing.

FIGS. 24 and 47 illustrate a mid-point position 188 of the back swing 186 of the arcuate path 16. After the waggle 184, the golf player 12 positions the golf club 14 into the mid-point 188 of the backswing 186. At the mid-point position 188 the golf player 12 should only be able to view the third color 90 or the red color of the exterior edge 80. Furthermore, the golf player 12 should not be able to view the first color 82, yellow color 84 or the second color 86, green color 88. With only the third color 90 exposed to the golf player 12 at the mid-point position 188 assures the face surface 26 will be aligned in the perpendicular alignment 180 with the golf club 18 at the starting position 182. The golf trainer 62 may also utilized the golf training device 10 for instructing the golf player 12 for positioning the face surface 26 in the perpendicular alignment 180 with the golf ball 18 at the starting position 182.

Plate Views for Mid-Point Position (Perpendicular Alignment)

Player:

Third-color 90 or red color 92;

No vision of first color 82, yellow color 84 or the second color 86, green color 88.

Trainer Face-to-Face:

First color 82 or yellow color 84;

No vision of second color 86, green color 88 or the third color 90, red color 92.

Trainer Front Side:

Third color 90 or red color 92;

No vision of first color 82, yellow color 84 or the second color 86, green color 88.

Trainer Rear Side:

Third color 90 or red color 92;

No vision of first color 82, yellow color 84 or the second color 86, green color 88.

Troubleshooting/Corrections:

Yellow color 84 showing: Open face surface 26 and/or over pronated left wrist Green color 88 showing: Closed face surface 26 and/or palm up on left hand.

Proper grip

Achieve shaking hands position:

Club position in front of body;

Club position parallel to the ground;

Early or partial shoulder rotation;

Toe of club pointing skyward;

Thumbs can point skyward;

Leading edge of plane showing.

Figure 25:
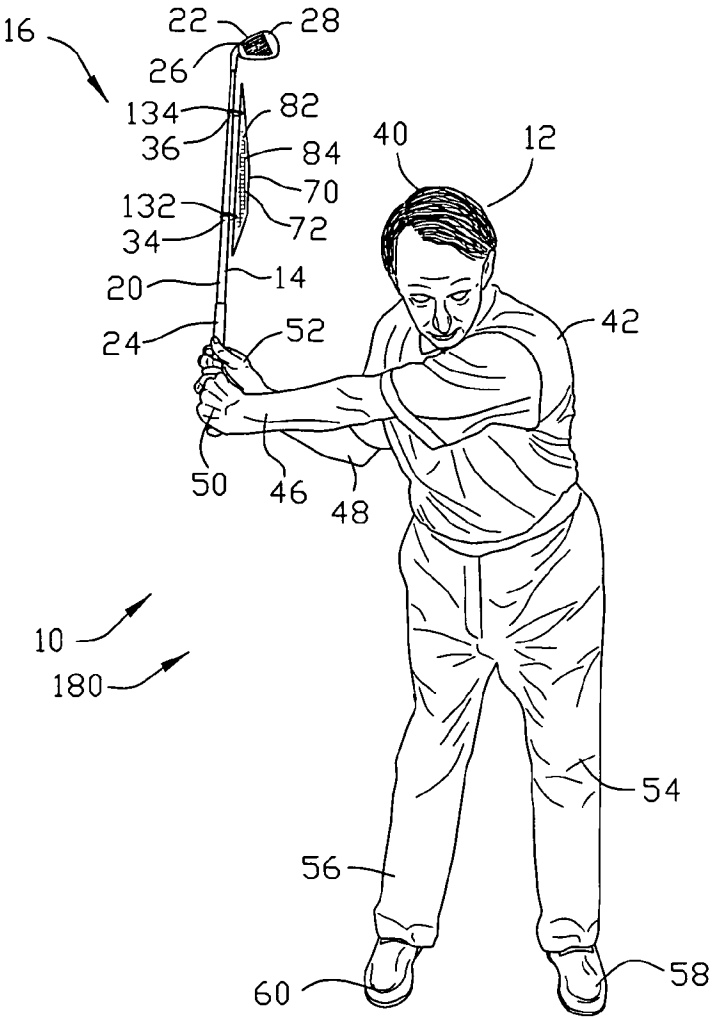
FIG. 25 is a front view similar to FIG. 24 illustrating a "L" position of the back swing.

FIGS. 25 and 47 illustrate a "L" position 192 of the back swing 186 of the arcuate path 16. After the mid-point position 188, the golf player 12 positions the golf club 14 into the "L" position 192 of the backswing 186. At the "L" position 192 the golf player 12 should only be able to view the third color 90 or the red color of the exterior edge 80. Furthermore, the golf player 12 should not be able to view the first color 82, yellow color 84 or the second color 86, green color 88. With only the third color 90 exposed to the golf player 12 at the mid-point position 188 assures the face surface 26 will be aligned in the perpendicular alignment 180 with the golf club 18 at the starting position 182. The golf trainer 62 may also utilized the golf training device 10 for instructing the golf player 12 for positioning the face surface 26 in the perpendicular alignment 180 with the golf ball 18 at the starting position 182.

Plate Views for "L" Position (Perpendicular Alignment)

Player:

Third color 90 or red color 92;

No vision of first color 82, yellow color 84 or the second color 86, green color 88.

Trainer Face-to-Face:

First color 82 or yellow color 84;

No vision of second color 86, green color 88 or the third color 90, red color 92.

Trainer Front Side:

Third color 90 or red color 92;

No vision of first color 82, yellow color 84 or the second color 86, green color 88.

Trainer Rear Side:

No vision of plate 70.

Troubleshooting/Corrections:

Yellow color 84 showing: Left wrist is cupping;

To flat a plate 70, butt of club not directed towards the ground;

Unable to maintain straight left arm.

Relax the grip;

Cock the wrist;

Maintain the left wrist in a flat or straighten position;

If physically possible, maintain the left arm in a straighten position;

Allow for further (¾) shoulder rotation.

Figure 26:
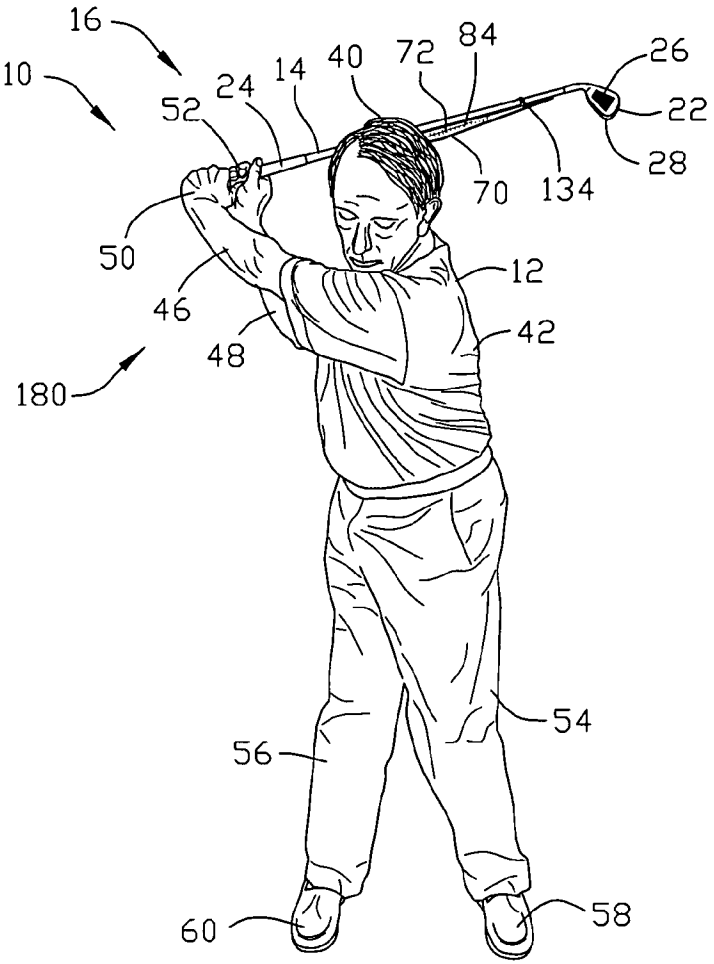
FIG. 26 is a front view similar to FIG. 25 illustrating a final point of the back swing.

FIGS. 26 and 47 illustrate a transition position 194 separating the back swing 186 from the down swing 196 of the arcuate path 16. After the "L" position 192, the golf player 12 positions the golf club 14 into the transition position 194 of the backswing 186. At the transition position 194 the golf player 12 should be able to view the third color 90 or the red color of the exterior edge 80 and/or partially the first color 82, yellow color 84. Furthermore, the golf player 12 should not be able to view the second color 86 or green color 88. With only the third color 90 and/or partially the first color 82 exposed to the golf player 12 at the transition position 194 assures the face surface 26 will be aligned in the perpendicular alignment 180 with the golf club 18 at the starting position 182. The golf trainer 62 may also utilized the golf training device 10 for instructing the golf player 12 for positioning the face surface 26 in the perpendicular alignment 180 with the golf ball 18 at the starting position 182.

Plate Views for Transition Position (Perpendicular Alignment)

Player:

Third color 90 or red color 92 and/or partially the first color 82, yellow color 84;

No vision of the second color 86, green color 88.

Trainer Face-to-Face:

Third color 90 or red color 92 and/or partially the first color 82, yellow color 84;

No vision of the second color 86, green color 88.

Trainer Front Side:

Predominately the third color 90 or red color 92;

Trainer Rear Side:

Predominately the first color 82, yellow color 84;

No vision of the second color 86, green color 88.

Troubleshooting/Corrections:

Yellow showing with leading edge pointing down: cupping of left wrist with or without right hand in the transition position 194;

Green showing: over pronated the right hand with an incomplete backswing position.

Maintain the "L" position and continue to rotate shoulders if possible;

Maintain the flat left wrist with the right palm facing more skyward.

Figure 27:
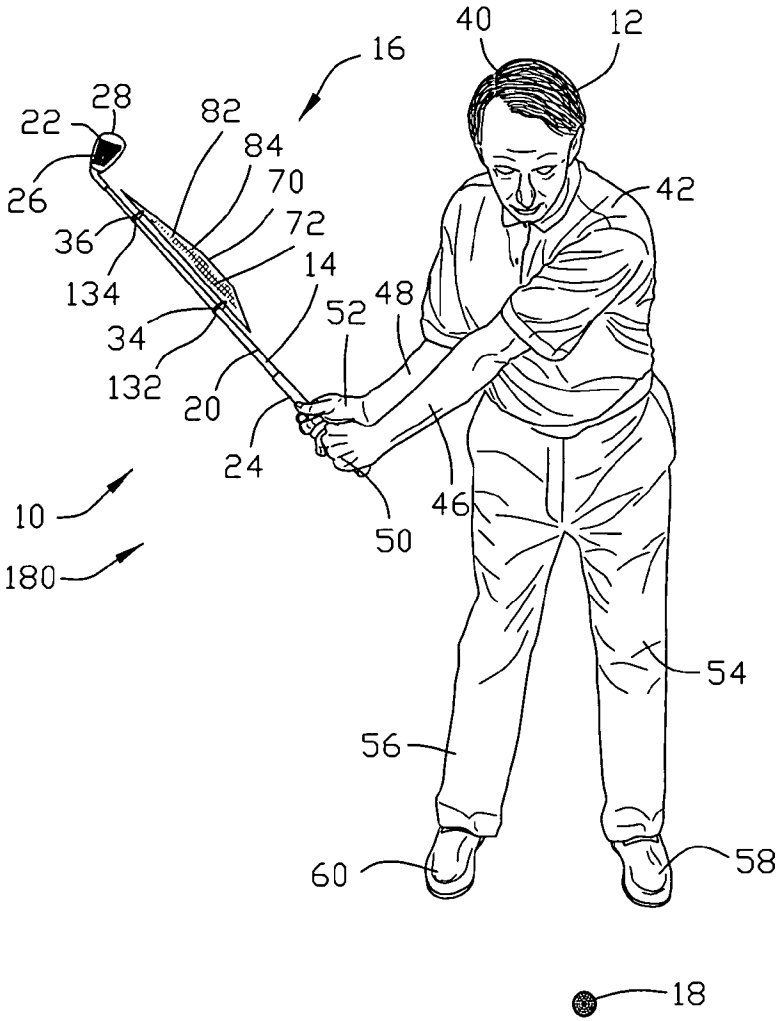
FIG. 27 is a front view similar to FIG. 26 illustrating a mid-point of a down swing.

FIGS. 27 and 47 illustrate a butt down position 198 of the down swing 196 of the arcuate path 16. After the transition position 194, the golf player 12 positions the golf club 14 into the butt down position 198 of the down swing 196. At the butt down position 198 the golf player 12 should only be able to view the third color 90 or the red color of the exterior edge 80. Furthermore, the golf player 12 should not be able to view the first color 82, yellow color 84 or the second color 86, green color 88. With only the third color 90 exposed to the golf player 12 at the butt down position 198 assures the face surface 26 will be aligned in the perpendicular alignment 180 with the golf club 18 at the starting position 182. The golf trainer 62 may also utilized the golf training device 10 for instructing the golf player 12 for positioning the face surface 26 in the perpendicular alignment 180 with the golf ball 18 at the starting position 182.

Plate Views for Butt Down Position (Perpendicular Alignment)

Player:

Third color 90 or red color 92;

No vision of first color 82, yellow color 84 or the second color 86, green color 88.

Trainer Face-to-Face:

First color 82 or yellow color 84;

No vision of second color 86, green color 88 or the third color 90, red color 92.

Trainer Front Side:

Minimal vision of second color 86, green color 88;

No vision of first color 82, yellow color 84.

Trainer Rear Side:

First color 82 or yellow color 84;

No vision of second color 86, green color 88 or the third color 90, red color 92.

Figure 28:
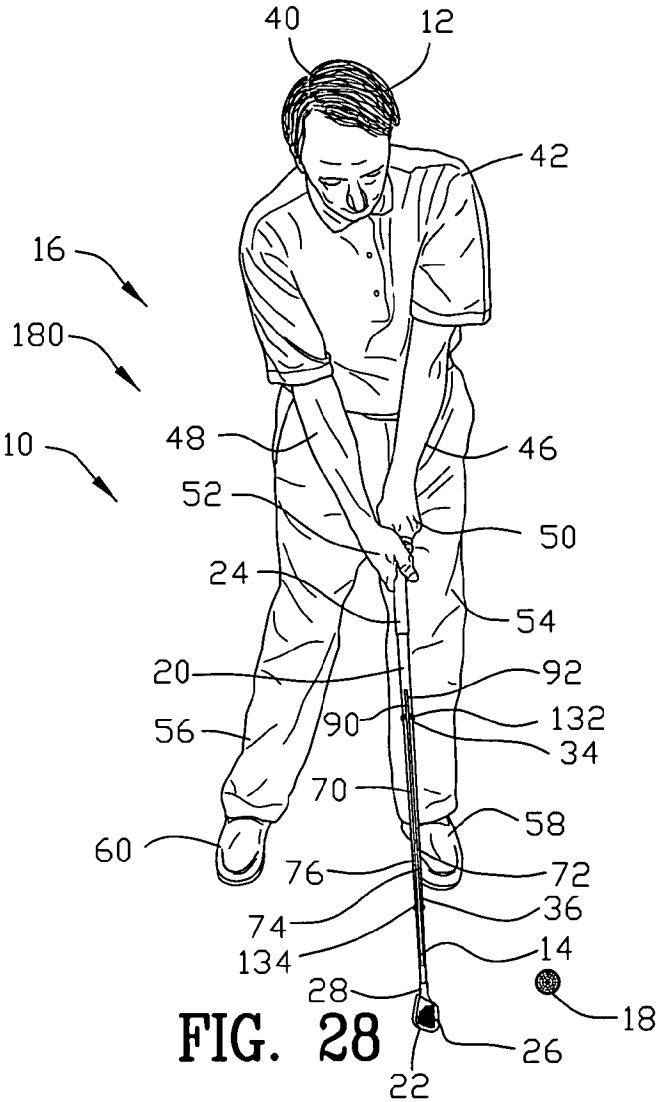
FIG. 28 is a front view similar to FIG. 27 illustrating a contact point of the down swing.

FIGS. 28, 32 and 47 illustrate a contact position 202 of the down swing 196 of the arcuate path 16. After the butt down position 198, the golf player 12 positions the golf club 14 into the contact position 202 of the down swing 196. During the contact position 202 the face surface 26 makes contact with the golf ball 18 at the perpendicular alignment 180. At the contact position 202 the golf player 12 should only be able to view the third color 90 or the red color of the exterior edge 80. Furthermore, the golf player 12 should not be able to view the first color 82, yellow color 84 or the second color 86, green color 88. With only the third color 90 exposed to the golf player 12 at the butt down position 198 assures the face surface 26 will be aligned in the perpendicular alignment 180 with the golf club 18 at the contact position 202. The golf trainer 62 may also utilized the golf training device 10 for instructing the golf player 12 for positioning the face surface 26 in the perpendicular alignment 180 with the golf ball 18 at the contact position 202.

Plate Views for Contact Position (Perpendicular Alignment)

Player:

Third color 90 or red color 92;

No vision of first color 82, yellow color 84 or the second color 86, green color 88.

Trainer Face-to-Face:

Third color 90 or red color 92;

No vision of first color 82, yellow color 84 or the second color 86, green color 88.

Trainer Front Side:

First color 82 or yellow color 84;

No vision of second color 86, green color 88 or third color 90, red color 92.

Trainer Rear Side:

Second color 86 or green color 88;

No vision of first color 82, yellow color 84 or third color 90, red color 92.

Troubleshooting/Corrections:

Yellow is showing, open face surface 26;

Green is showing, closed face surface 26.

Stuck inside, hands too close to the body;

Tension in the grip, blocking;

Casting, come over the top, bringing the clubface from the outside;

Improper weight transference;

Over-pronation of the right wrist.

Figure 29:
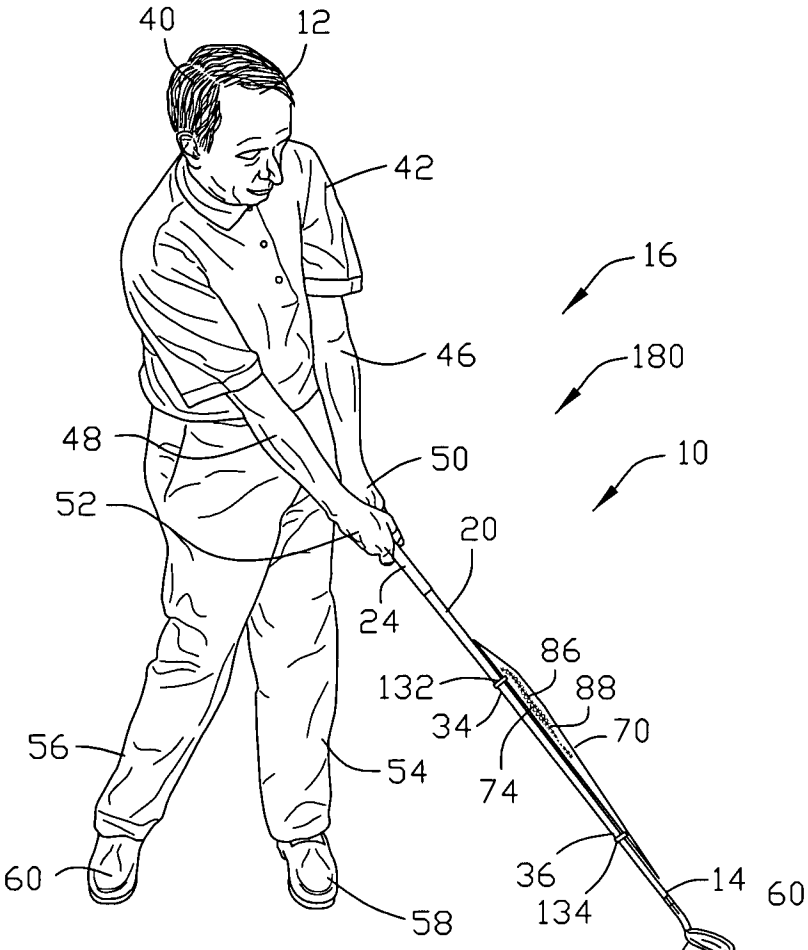
Figure 34:
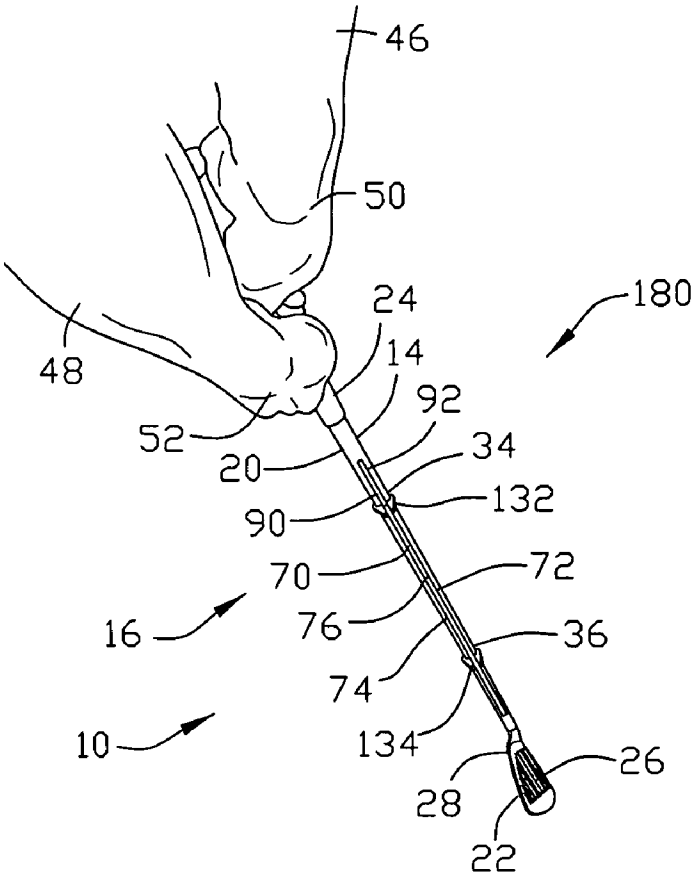

FIGS. 29, 34 and 47 illustrate a follow through position 204 of a follow through 206 of the arcuate path 16. After the contact position 202, the golf player 12 positions the golf club 14 into the follow through position 204 of the follow through 206. At the follow through position 204 the golf player 12 should be able to predominately view the third color 90 or the red color of the exterior edge 80. With the third color 90 predominately exposed to the golf player 12 at the follow through position 204 assures the face surface 26 was aligned in the perpendicular alignment 180 with the golf club 18 at the contact position 202. The golf trainer 62 may also utilized the golf training device 10 for instructing the golf player 12 for positioning the face surface 26 in the perpendicular alignment 180 with the golf ball 18 at the contact position 202.

Plate Views for Follow Through Position (Perpendicular Alignment)

Player:

Predominately the third color 90 or red color 92;

Trainer Face-to-Face:

Predominately the third color 90 or red color 92;

Minimal vision of the second color 86, green color 88.

Trainer Front Side:

Predominately the first color 82 or yellow color 84;

Minimal vision of the third color 90, red color 92.

Trainer Rear Side:

Second color 86 or green color 88;

No vision of first color 82, yellow color 84 or third color 90, red color 92.

Figure 30:
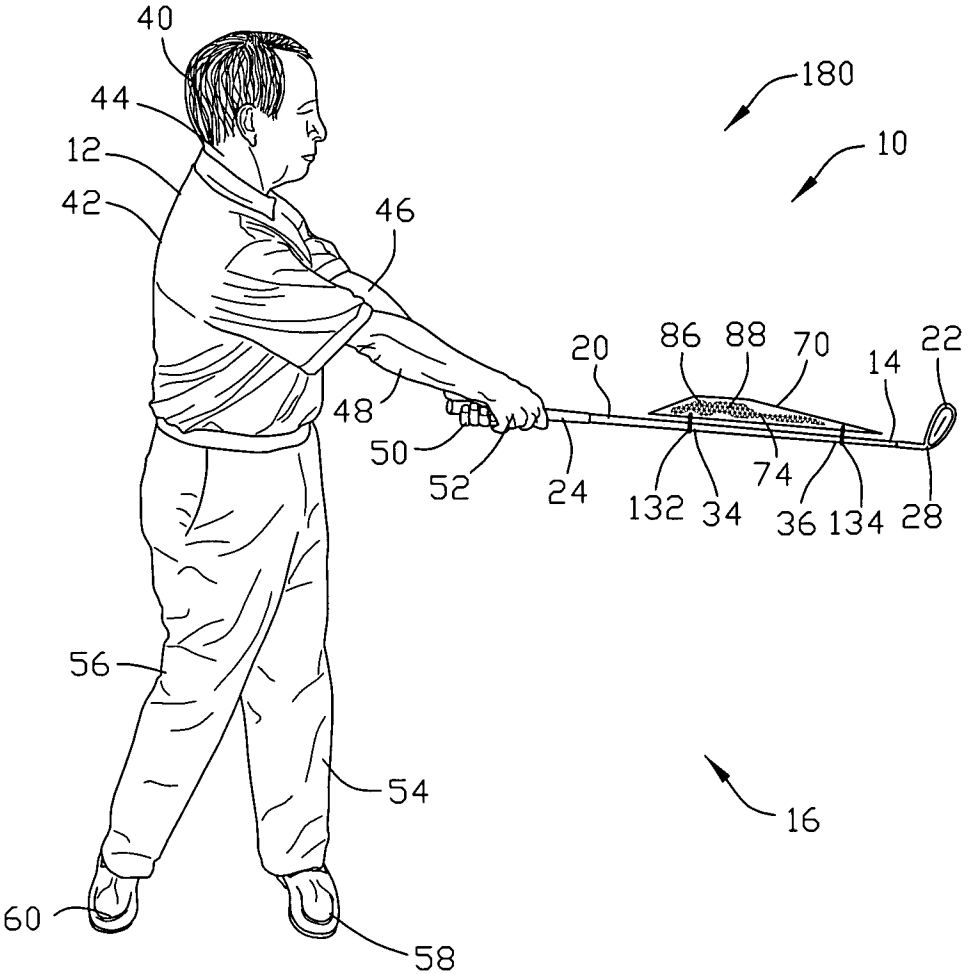

FIGS. 30 and 47 illustrate a mid-follow through position 208 of a follow through 206 of the arcuate path 16. After the follow through position 204, the golf player 12 positions the golf club 14 into the mid-follow through position 208 of the follow through 206. At the mid-follow through position 208 the golf player 12 will be able to predominately view the third color 90 or the red color of the exterior edge 80. The golf player 12 may further be able to minimally view the second color 86 or the green color 88 depending on the pronation of the right wrist. With the third color 90 predominately exposed to the golf player 12 at the mid-follow through position 208 assures the face surface 26 was aligned in the perpendicular alignment 180 with the golf club 18 at the contact position 202. The golf trainer 62 may also utilized the golf training device 10 for instructing the golf player 12 for positioning the face surface 26 in the perpendicular alignment 180 with the golf ball 18 at the contact position 202.

Plate Views for Mid-Follow Through Position (Perpendicular Alignment)

Player:

Predominately the third color 90 or red color 92;

Possible minimal vision of the second color 86 or the green color 88.

Trainer Face-to-Face:

Second color 86 or green color 88;

No vision of first color 82, yellow color 84 or third color 90, red color 92.

Trainer Front Side:

Predominately the third color 90 or red color 92;

Minimal vision of the second color 86 or green color 88.

Trainer Rear Side:

Third color 90 or red color 92;

No vision of first color 82, yellow color 84 or second color 86 or green color 88.

Figure 31:
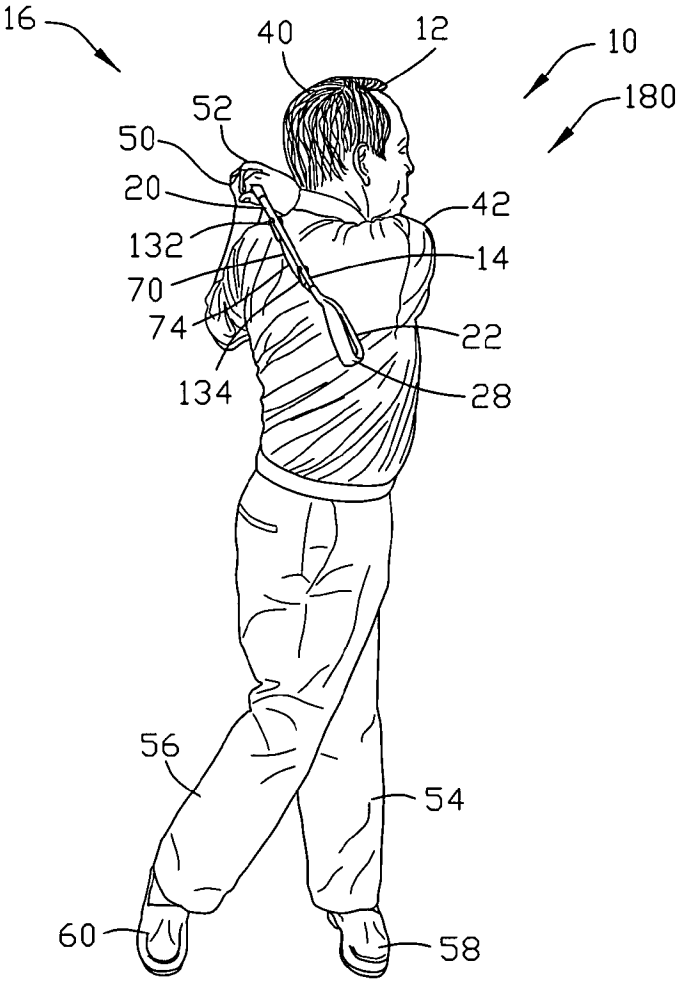
FIG. 31 is a front view similar to FIG. 30 illustrating a mid-point of a down swing

FIGS. 31 and 47 illustrate a termination position 212 of a follow through 206 of the arcuate path 16. At the termination position 212 the golf player 12 and the golf trainer 62 will be able one or more of the first color 82, yellow color 84; second color 86, green color 88 or third color 90, red color 92 dependent on the golf players habits.

Figure 37:
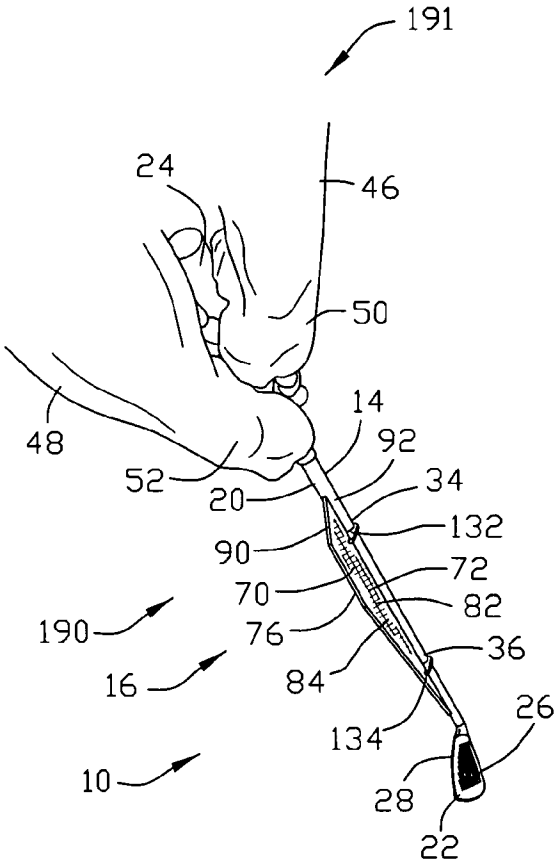
Figure 36:
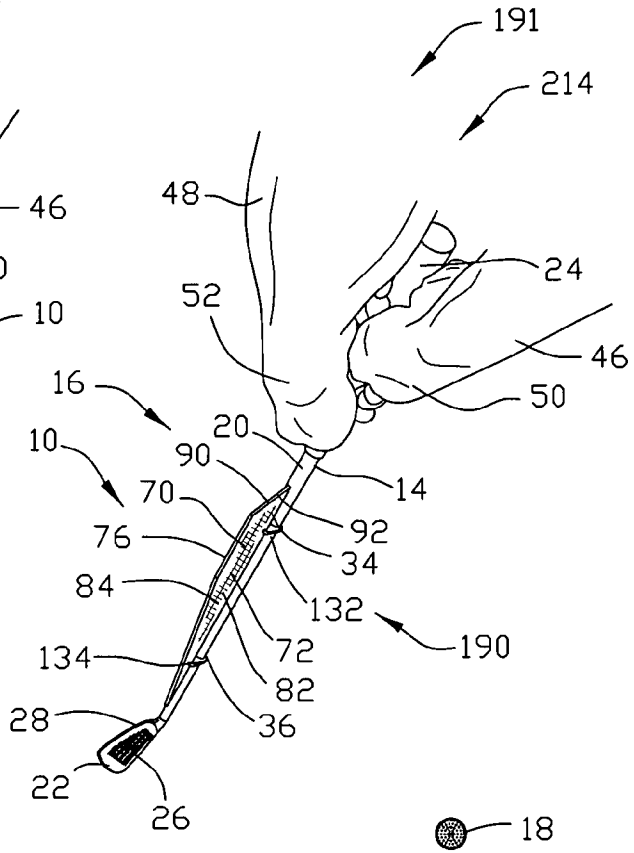
FIG. 36 is a view similar to FIG. 35 illustrating a takeaway point of the back swing.
Figure 35:
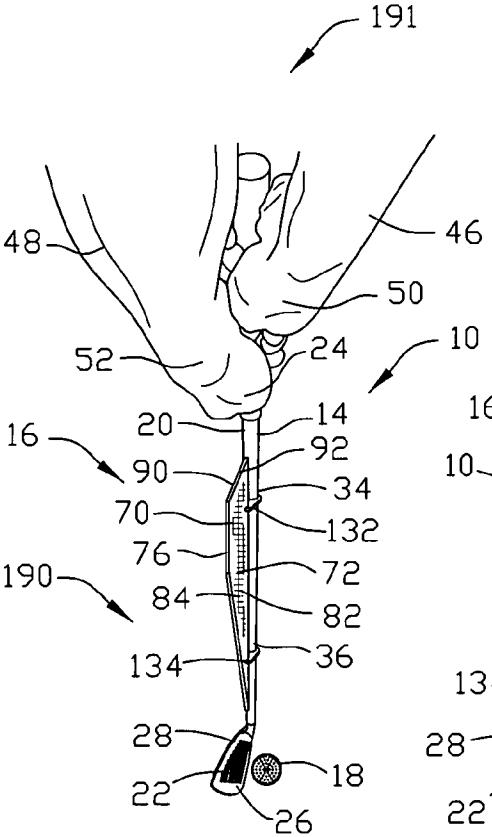
FIG. 35 is a view similar to FIG. 32 illustrating an open non-perpendicular alignment between golf club and the golf ball.

FIGS. 35-46 illustrate the golf training device 10 utilized for aligning the golf club 14 through the arcuate path 16 for contacting the golf ball 18 wherein the face surface 26 is in a non-perpendicular alignment with the golf ball 18. FIGS. 35-37, illustrate various positions of the golf player 12 swinging a golf club 14 through the arcuate path 16 for producing an open non-perpendicular alignment 190 between the face surface 26 of the golf club 14 and the golf ball 18. The open non-perpendicular alignment 190 between the face surface 26 of the golf club 14 and the golf ball 18 propel the golf ball 18 in a left to right curving trajectory 191. The golf training device 10 may also be utilized by a golf trainer 62, who is positioned adjacent to the golf player 12. More specifically, the golf trainer 62 may be positioned in a face-to-face orientation 94 with the golf player 12, in a front side orientation 96 with the golf player 12 or a rear side orientation 98 with the golf player 12. The golf training device 10 permits the golf trainer 62 to view the plate 70 to determine the alignment of the golf club 14 through the arcuate path 16 for contacting the golf ball 18. The golf trainer 62 would then be able to recommend altering the performance of the golf player 12 if the arcuate path 16 was not correct.

FIGS. 35 and 47, illustrate a starting position 182 of the arcuate path 16 for the open non-perpendicular alignment 190. Once the golf player 12 has correctly postured the body 42 and the head 40 and has gripped the grip 24 with the first hand 50 and the second hand 52, the golf player 12 proceeds to adjust the position of the head 22 until the golf player 12 is able to view the third color 90 or red color 92 of the exterior edge 80 and a portion of the first color 82 or the yellow color 84 of the face side 72. Once the golf player 12 has acquired view of both the third color 90, a portion of the first color 82 and without viewing the second color 86, the face surface 26 will be positioned in the open non-perpendicular alignment 190 with the golf ball 18. The golf trainer 62 may also utilized the golf training device 10 for instructing the golf player 12 for positioning the face surface 26 in the open non-perpendicular alignment 190 with the golf ball 18 at the starting position 182.

Plate Views for Starting Position (Open Non-Perpendicular Alignment)

Player:
Third color 90 or red color 92;
Minimal vision of first color 82 or yellow color 84;
No vision of the second color 86, green color 88.

Trainer Face-to-Face:
Third color 90 or red color 92;
Minimal vision of first color 82 or yellow color 84;
No vision of the second color 86, green color 88.

Trainer Front Side:
First color 82 or yellow color 84;
Minimal vision of third color 90 or red color 92;
No vision of second color 86, green color 88.

Trainer Rear Side:
Second color 86 or green color 88;
Minimal vision of third color 90 or red color 92;
No vision of first color 82, yellow color 84.

FIGS. 36 and 47, illustrate a takeaway position 214 of the arcuate path 16 for the open non-perpendicular alignment 190. After the starting position 182, the golf player 12 positions the golf club 14 into the takeaway position 214 of the back swing 186. At the takeaway position 214 the golf player 12 should be able to view the third color 90 or the red color of the exterior edge 80 and partially the first color 82, yellow color 84. Furthermore, the golf player 12 should not be able to view the second color 86 or green color 88. With only the third color 90 and partially the first color 82 exposed to the golf player 12 at the takeaway position 214 assures the face surface 26 will be aligned in the open non-perpendicular alignment 190 with the golf club 18 at the starting position 182. The golf trainer 62 may also utilized the golf training device 10 for instructing the golf player 12 for positioning the face surface 26 in the open non-perpendicular alignment 190 with the golf ball 18 at the starting position 182.

Plate Views for Takeaway Position (Open Non-Perpendicular Alignment)

Player:
Third color 90 or red color 92;
Minimal vision of first color 82 or yellow color 84;
No vision of the second color 86, green color 88.

Trainer Face-to-Face:
Third color 90 or red color 92;
Minimal vision of first color 82 or yellow color 84;
No vision of the second color 86, green color 88.

Trainer Front Side:
First color 82 or yellow color 84;
Minimal vision of third color 90 or red color 92;
No vision of second color 86, green color 88.

Trainer Rear Side:
Second color 86 or green color 88;
Minimal vision of third color 90 or red color 92;
No vision of first color 82, yellow color 84.

FIGS. 37 and 47, illustrate a follow through position 204 of the arcuate path 16 for the open non-perpendicular alignment 190. After the takeaway position 214, the golf player 12 positions the golf club 14 into the follow through position 204 of the follow through 206. At the follow through position 204 the golf player 12 should be able to view the third color 90 or the red color of the exterior edge 80 and partially the first color 82, yellow color 84. Furthermore, the golf player 12 should not be able to view the second color 86 or green color 88. With only the third color 90 and partially the first color 82 exposed to the golf player 12 at the takeaway position 214 assures the face surface 26 was aligned in the open non-perpendicular alignment 190 with the golf club 18 at the starting position 182. The golf trainer 62 may also utilized the golf training device 10 for instructing the golf player 12 for positioning the face surface 26 in the open non-perpendicular alignment 190 with the golf ball 18 at the starting position 182.

Plate Views for Follow Through Position (Open Non-Perpendicular Alignment)

Player:
Third color 90 or red color 92;
Minimal vision of first color 82 or yellow color 84;
No vision of the second color 86, green color 88.

Trainer Face-to-Face:
Third color 90 or red color 92;
Minimal vision of first color 82 or yellow color 84;
No vision of the second color 86, green color 88.

Trainer Front Side:
First color 82 or yellow color 84;
Minimal vision of third color 90 or red color 92;
No vision of second color 86, green color 88.

Trainer Rear Side:
Second color 86 or green color 88;
Minimal vision of third color 90 or red color 92;
No vision of first color 82, yellow color 84.

Figure 40:
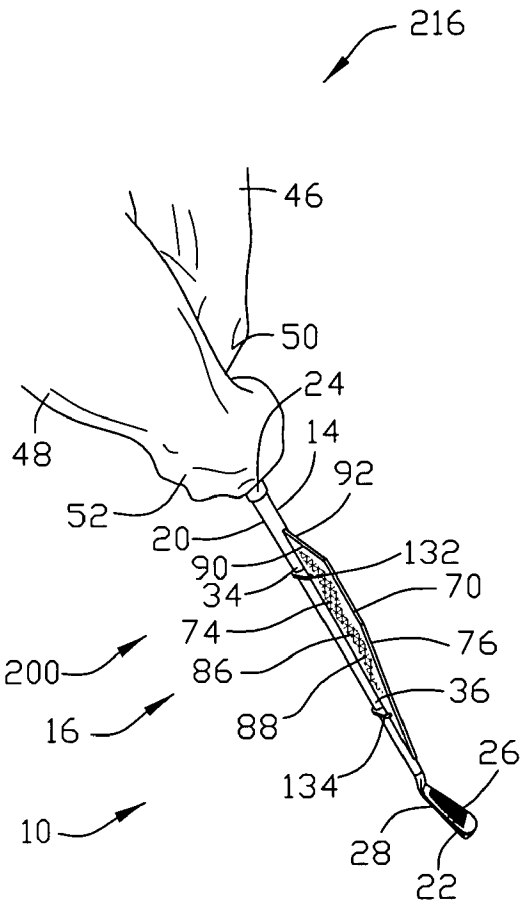
Figure 39:
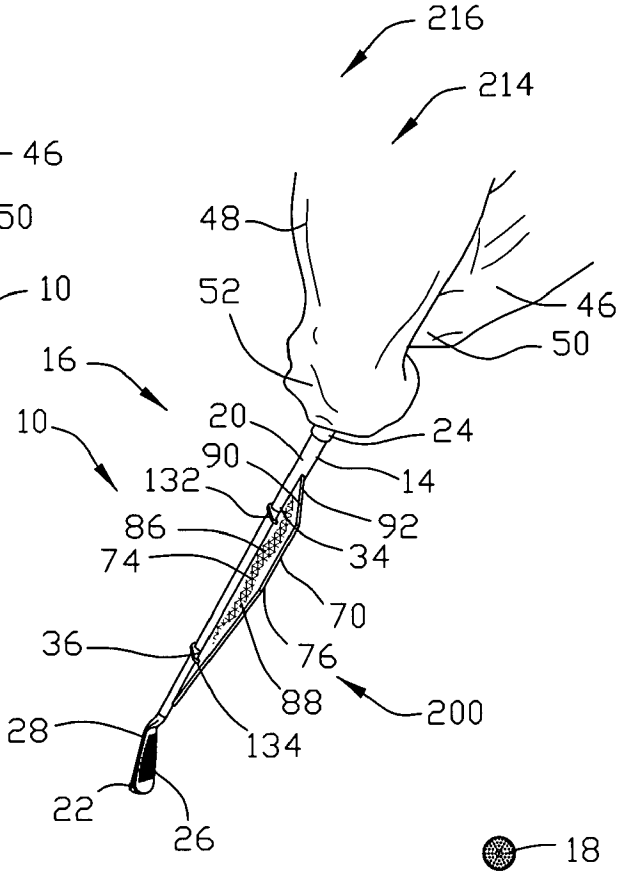
FIG. 39 is a view similar to FIG. 38 illustrating a takeaway point of the back swing.
Figure 38:
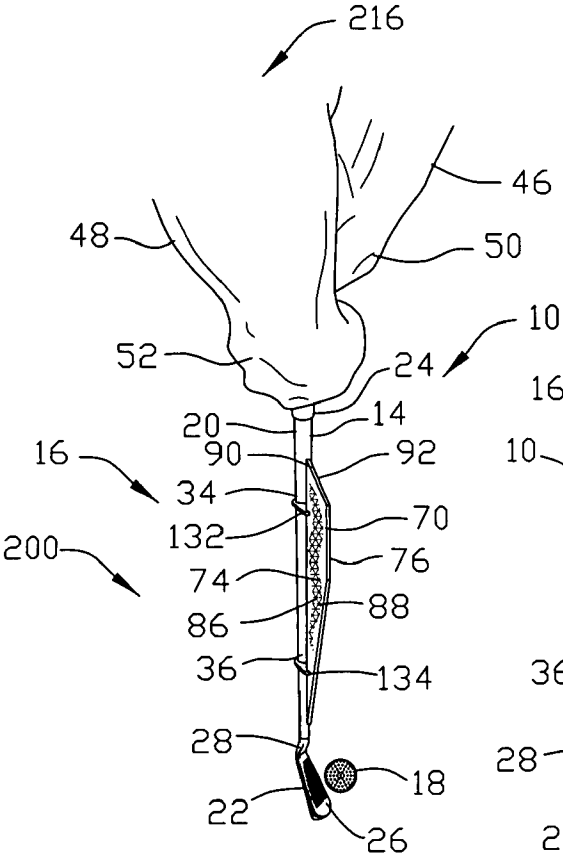
FIG. 38 is a view similar to FIG. 32 illustrating a closed non-perpendicular alignment between golf club and the golf ball.

FIGS. 38-40, illustrate various positions of the golf player 12 swinging a golf club 14 through the arcuate path 16 for producing a closed non-perpendicular alignment 200 between the face surface 26 of the golf club 14 and the golf ball 18. The closed non-perpendicular alignment 200 between the face surface 26 of the golf club 14 and the golf ball 18 propel the golf ball 18 in a right to left curving trajectory 216. The golf training device 10 may also be utilized by a golf trainer 62, who is positioned adjacent to the golf player 12. More specifically, the golf trainer 62 may be positioned in a face-to-face orientation 94 with the golf player 12, in a front side orientation 96 with the golf player 12 or a rear side orientation 98 with the golf player 12. The golf training device 10 permits the golf trainer 62 to view the plate 70 to determine the alignment of the golf club 14 through the arcuate path 16 for contacting the golf ball 18. The golf trainer 62 would then be able to recommend altering the performance of the golf player 12 if the arcuate path 16 was not correct.

FIGS. 38 and 47, illustrate a starting position 182 of the arcuate path 16 for the closed non-perpendicular alignment 200. Once the golf player 12 has correctly postured the body 42 and the head 40 and has gripped the grip 24 with the first and 50 and the secondhand 52, the golf player 12 proceeds to adjust the position of the head 22 until the golf player 12 is able to view the third color 90 or red color 92 of the exterior edge 80 and a portion of the second color 86 or the green color 88 of the back side 74. Once the golf player 12 has acquired view of both the third color 90, a portion of the second color 86 and without viewing the first color 82, the face surface 26 will be positioned in the closed non-perpendicular alignment 200 with the golf ball 18. The golf trainer 62 may also utilized the golf training device 10 for instructing the golf player 12 for positioning the face surface 26 in the closed non-perpendicular alignment 200 with the golf ball 18 at the starting position 182.

Plate Views for Starting Position (Closed Non-Perpendicular Alignment)

Player:
Third color 90 or red color 92;
Minimal vision of second color 86, green color 88;
No vision of the first color 82 or yellow color 84.

Trainer Face-to-Face:
Third color 90 or red color 92;
Minimal vision of second color 86, green color 88;
No vision of the first color 82 or yellow color 84.

Trainer Front Side:
Third color 90 or red color 92;
Minimal vision of first color 82 or yellow color 84;
No vision of second color 86, green color 88.

Trainer Rear Side:
Second color 86 or green color 88;
Minimal vision of third color 90 or red color 92;
No vision of first color 82, yellow color 84.

FIGS. 39 and 47, illustrate a takeaway position 214 of the arcuate path 16 for the closed non-perpendicular alignment 200. After the starting position 182, the golf player 12 positions the golf club 14 into the takeaway position 214 of the back swing 186. At the takeaway position 214 the golf player 12 should be able to view the third color 90 or the red color of the exterior edge 80 and partially the second color 82, green color 88. Furthermore, the golf player 12 should not be able to view the first color 82 or yellow color 84. With only the third color 90 and partially the second color 82 exposed to the golf player 12 at the takeaway position 214 assures the face surface 26 will be aligned in the closed non-perpendicular alignment 200 with the golf club 18 at the starting position 182. The golf trainer 62 may also utilized the golf training device 10 for instructing the golf player 12 for positioning the face surface 26 in the closed non-perpendicular alignment 200 with the golf ball 18 at the starting position 182.

Plate Views for Takeaway Position (Closed Non-Perpendicular Alignment)

Player:
Third color 90 or red color 92;
Minimal vision of second color 86, green color 88;
No vision of the first color 82 or yellow color 84.

Trainer Face-to-Face:
Third color 90 or red color 92;
Minimal vision of second color 86, green color 88;
No vision of the first color 82 or yellow color 84.

Trainer Front Side:
Third color 90 or red color 92;
Minimal vision of first color 82 or yellow color 84;
No vision of second color 86, green color 88.

Trainer Rear Side:
Second color 86 or green color 88;
Minimal vision of third color 90 or red color 92;
No vision of first color 82, yellow color 84.

FIGS. 40 and 47, illustrate a follow through position 204 of the arcuate path 16 for the closed non-perpendicular alignment 200. After the takeaway position 214, the golf player 12 positions the golf club 14 into the follow through position 204 of the follow through 206. At the follow through position 204 the golf player 12 should be able to view the third color 90 or the red color of the exterior edge 80 and partially the second color 86, green color 88. Furthermore, the golf player 12 should not be able to view the first color 82 or yellow color 84. With only the third color 90 and partially the second color 86 exposed to the golf player 12 at the takeaway position 214 assures the face surface 26 was aligned in the closed non-perpendicular alignment 200 with the golf club 18 at the starting position 182. The golf trainer 62 may also utilized the golf training device 10 for instructing the golf player 12 for positioning the face surface 26 in the open non-perpendicular alignment 190 with the golf ball 18 at the starting position 182.

Plate Views for Takeaway Position (Closed Non-Perpendicular Alignment)

Player:
Third color 90 or red color 92;
Minimal vision of second color 86, green color 88;
No vision of the first color 82 or yellow color 84.

Trainer Face-to-Face:
Third color 90 or red color 92;
Minimal vision of second color 86, green color 88;
No vision of the first color 82 or yellow color 84.

Trainer Front Side:
Third color 90 or red color 92;
Minimal vision of first color 82 or yellow color 84;
No vision of second color 86, green color 88.

Trainer Rear Side:
Second color 86 or green color 88;
Minimal vision of third color 90 or red color 92;
No vision of first color 82, yellow color 84.

Figure 43:
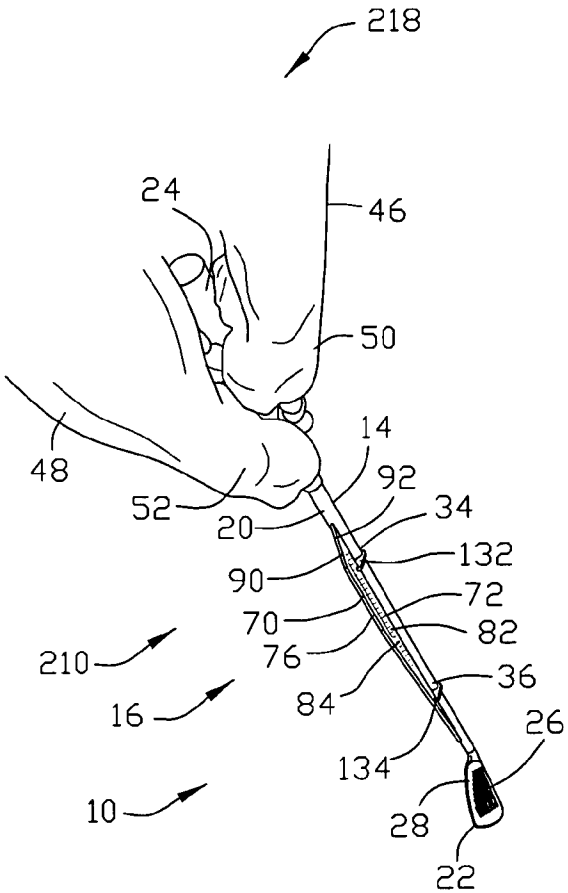
Figure 42:
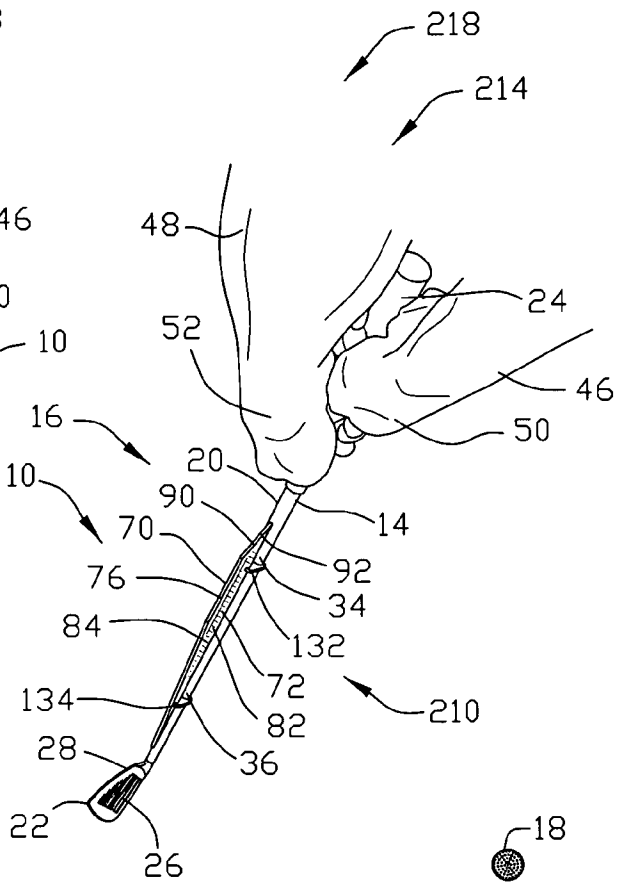
FIG. 42 is a view similar to FIG. 41 illustrating a takeaway point of the back swing.
Figure 41:
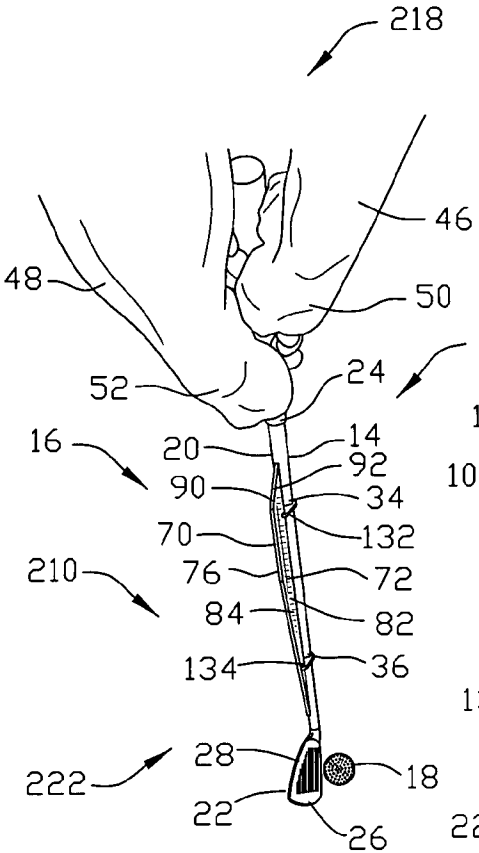
FIG. 41 is a view similar to FIG. 32 illustrating a rear incline perpendicular alignment between golf club and the golf ball.

FIGS. 41-43, illustrate various positions of the golf player 12 swinging a golf club 14 through the arcuate path 16 for producing a rear incline perpendicular alignment 210 between the face surface 26 of the golf club 14 and the golf ball 18. The rear incline perpendicular alignment 210 between the face surface 26 of the golf club 14 and the golf ball 18 propel the golf ball 18 in a straight trajectory with the golf ball 18 having a reverse rotation 218. The golf training device 10 may also be utilized by a golf trainer 62, who is positioned adjacent to the golf player 12. More specifically, the golf trainer 62 may be positioned in a face-to-face orientation 94 with the golf player 12, in a front side orientation 96 with the golf player 12 or a rear side orientation 98 with the golf player 12. The golf training device 10 permits the golf trainer 62 to view the plate 70 to determine the alignment of the golf club 14 through the arcuate path 16 for contacting the golf ball 18. The golf trainer 62 would then be able to recommend altering the performance of the golf player 12 if the arcuate path 16 was not correct.

FIGS. 41 and 47, illustrate a starting position 182 of the arcuate path 16 for the rear incline perpendicular alignment 210. Once the golf player 12 has correctly postured the body 42 and the head 40 and has gripped the grip 24 with the first hand 50 and the second hand 52, the golf player 12 proceeds to adjust the position of the head 22 until the golf player 12 is able to view the third color 90 or red color 92 of the exterior edge 80 and a mininscle portion of the first color 82 or the yellow color 84 of the face side 72. Furthermore, the shaft 20 of the golf club 14 is orientated such that the head 22 is forward of the grip 24 for creating a rear non-vertical shaft slope 222. Once the golf player 12 has acquired view of both the third color 90, a mininscle portion of the first color 82, the rear non-vertical shaft slope 222 and without viewing the second color 86, the face surface 26 will be positioned in the rear incline perpendicular alignment 210 with the golf ball 18. The golf trainer 62 may also utilized the golf training device 10 for instructing the golf player 12 for positioning the face surface 26 in the rear incline perpendicular alignment 210 with the golf ball 18 at the starting position 182.

Plate Views for Starting Position (Rear Incline Perpendicular Alignment)

Player:
Third color 90 or red color 92;
Mininscle vision of first color 82 or yellow color 84;
No vision of the second color 86, green color 88;
Head 22 forward of the Grip 24.

Trainer Face-to-Face:
Third color 90 or red color 92;
Mininscle vision of first color 82 or yellow color 84;
No vision of the second color 86, green color 88;
Head 22 forward of the Grip 24.

Trainer Front Side:
First color 82 or yellow color 84;
No vision of second color 86, green color 88 or third color 90 or red color 92.

Trainer Rear Side:
Second color 86 or green color 88;
Mininscle vision of third color 90 or red color 92;
No vision of first color 82, yellow color 84.

FIGS. 42 and 47, illustrate a takeaway position 214 of the arcuate path 16 for the rear incline perpendicular alignment 210. After the starting position 182, the golf player 12 positions the golf club 14 into the takeaway position 214 of the back swing 186. At the takeaway position 214 the golf player 12 should be able to view the third color 90 or the red color of the exterior edge 80 and mininscle portion of the first color 82, yellow color 84. Furthermore, the golf player 12 should not be able to view the second color 86 or green color 88. With only the third color 90 and a mininscle portion of the first color 82 exposed to the golf player 12 at the takeaway position 214 assures the face surface 26 will be aligned in the rear incline perpendicular alignment 210 with the golf club 18 at the starting position 182. The golf trainer 62 may also utilized the golf training device 10 for instructing the golf player 12 for positioning the face surface 26 in the open non-perpendicular alignment 190 with the golf ball 18 at the starting position 182.

Plate Views for Takeaway Position (Rear Incline Perpendicular Alignment)

Player:
Third color 90 or red color 92;
Mininscle portion of first color 82 or yellow color 84;
No vision of the second color 86, green color 88.

Trainer Face-to-Face:
Third color 90 or red color 92;
Mininscle portion of first color 82 or yellow color 84;
No vision of the second color 86, green color 88.

Trainer Front Side:
First color 82 or yellow color 84;
No vision of second color 86, green color 88 or third color 90 or red color 92.

Trainer Rear Side:
Second color 86 or green color 88;
Mininscle portion of third color 90 or red color 92;
No vision of first color 82, yellow color 84.

FIGS. 43 and 47, illustrate a follow through position 204 of the arcuate path 16 for the rear incline perpendicular alignment 210. After the takeaway position 214, the golf player 12 positions the golf club 14 into the follow through position 204 of the follow through 206. At the follow through position 204 the golf player 12 should be able to view the third color 90 or the red color of the exterior edge 80 and mininscle portion of the first color 82, yellow color 84. Furthermore, the golf player 12 should not be able to view the second color 86 or green color 88. With only the third color 90 and a mininscle portion of the first color 82 exposed to the golf player 12 at the takeaway position 214 assures the face surface 26 was aligned in the rear incline perpendicular alignment 210 with the golf club 18 at the starting position 182. The golf trainer 62 may also utilized the golf training device 10 for instructing the golf player 12 for positioning the face surface 26 in the open non-perpendicular alignment 190 with the golf ball 18 at the starting position 182.

Plate Views for Follow Through Position (Rear Incline Perpendicular Alignment)

Player:
Third color 90 or red color 92;
Mininscle portion of first color 82 or yellow color 84;
No vision of the second color 86, green color 88.

Trainer Face-to-Face:
Third color 90 or red color 92;
Mininscle portion of first color 82 or yellow color 84;
No vision of the second color 86, green color 88.

Trainer Front Side:
First color 82 or yellow color 84;
No vision of second color 86, green color 88 or third color 90 or red color 92.

Trainer Rear Side:
Second color 86 or green color 88;
Mininscle portion of third color 90 or red color 92;
No vision of first color 82, yellow color 84.

Figure 46:
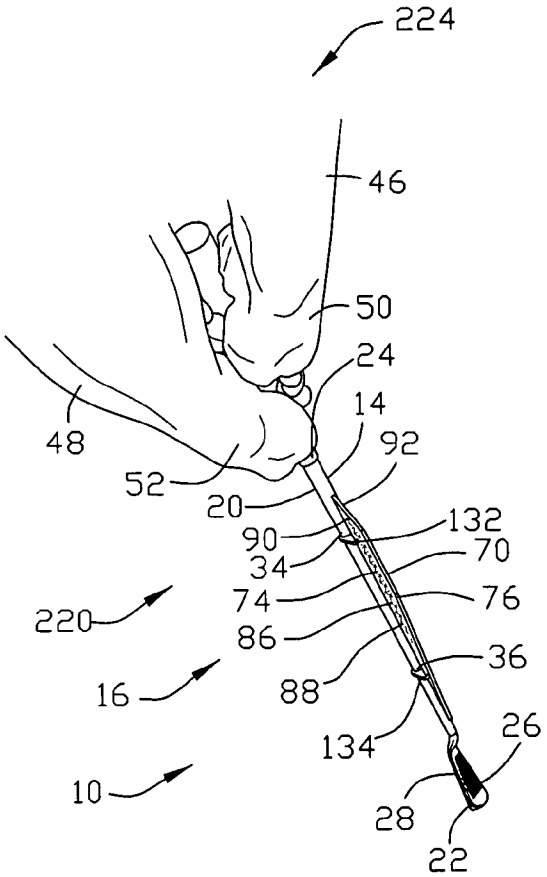
Figure 45:
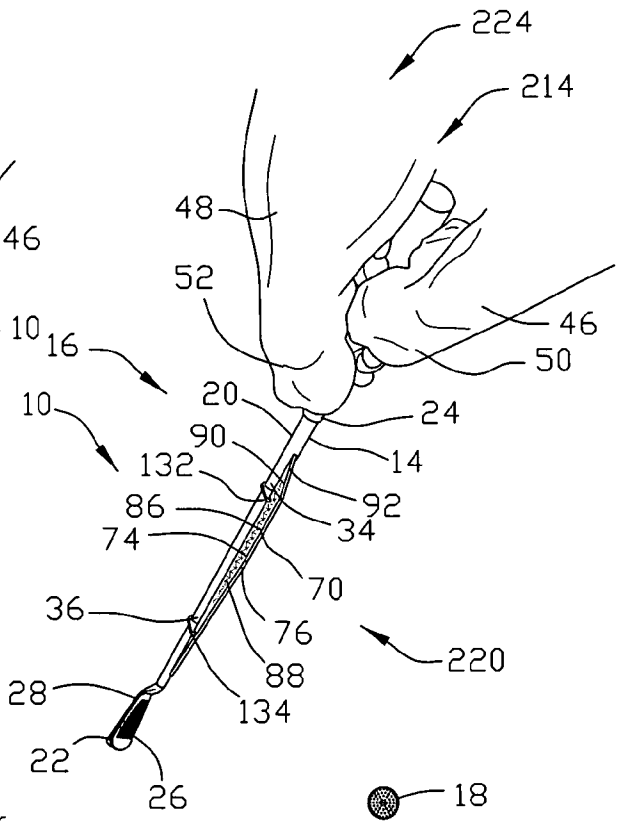
FIG. 45 is a view similar to FIG. 44 illustrating a takeaway point of the back swing.
Figure 44:
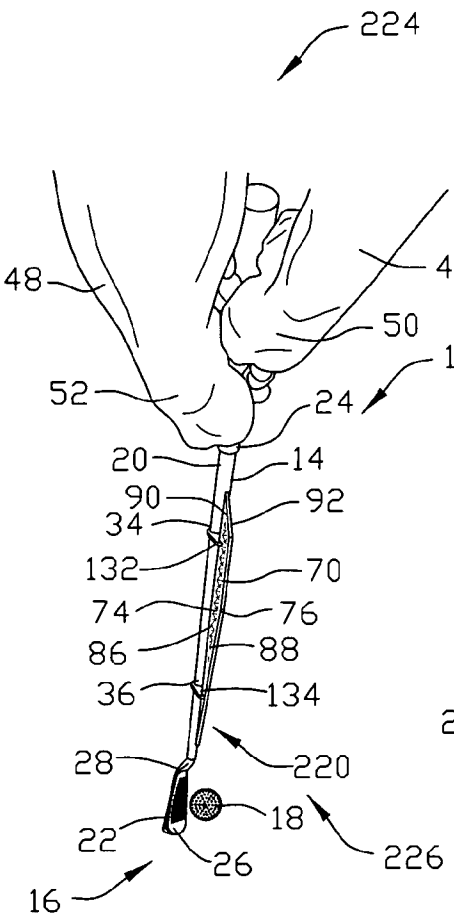
FIG. 44 a is a view similar to FIG. 32 illustrating a forward incline perpendicular alignment between golf club and the golf ball.

FIGS. 44-46, illustrate various positions of the golf player 12 swinging a golf club 14 through the arcuate path 16 for producing a forward incline perpendicular alignment 220 between the face surface 26 of the golf club 14 and the golf ball 18. The forward incline perpendicular alignment 220 between the face surface 26 of the golf club 14 and the golf ball 18 propel the golf ball 18 in a straight trajectory with the golf ball 18 having a forward rotation 224. The golf training device 10 may also be utilized by a golf trainer 62, who is positioned adjacent to the golf player 12. More specifically, the golf trainer 62 may be positioned in a face-to-face orientation 94 with the golf player 12, in a front side orientation 96 with the golf player 12 or a rear side orientation 98 with the golf player 12. The golf training device 10 permits the golf trainer 62 to view the plate 70 to determine the alignment of the golf club 14 through the arcuate path 16 for contacting the golf ball 18. The golf trainer 62 would then be able to recommend altering the performance of the golf player 12 if the arcuate path 16 was not correct.

FIGS. 44 and 47, illustrate a starting position 182 of the arcuate path 16 for the forward incline perpendicular alignment 220. Once the golf player 12 has correctly postured the body 42 and the head 40 and has gripped the grip 24 with the first hand 50 and the second hand 52, the golf player 12 proceeds to adjust the position of the head 22 until the golf player 12 is able to view the third color 90 or red color 92 of the exterior edge 80 and a mininscle portion of the second color 86 or the green color 88 of the back side 74. Furthermore, the shaft 20 of the golf club 14 is orientated such that the grip 24 is forward of the head 22 for creating a forward non-vertical shaft slope 226. Once the golf player 12 has acquired view of both the third color 90, a mininscle portion of the second color 86, a forward non-vertical shaft slope 226 and without viewing the first color 82, the face surface 26 will be positioned in the forward incline perpendicular alignment 220 with the golf ball 18. The golf trainer 62 may also utilized the golf training device 10 for instructing the golf player 12 for positioning the face surface 26 in the forward incline perpendicular alignment 220 with the golf ball 18 at the starting position 182.

Plate Views for Starting Position (Forward Incline Perpendicular Alignment)

Player:
Third color 90 or red color 92;
Mininscle portion of second color 86, green color 88;
No vision of the first color 82 or yellow color 84;
Grip 24 forward of the head 22

Trainer Face-to-Face:
Third color 90 or red color 92;
Mininscle portion of second color 86, green color 88;
No vision of the first color 82 or yellow color 84;
Grip 24 forward of the head 22.

Trainer Front Side:
First color 82 or yellow color 84;
Mininscle portion of third color 90 or red color 92;
No vision of second color 86, green color 88.

Trainer Rear Side:
Second color 86 or green color 88;
No vision of first color 82, yellow color 84 or third color 90 or red color 92.

FIGS. 45 and 47, illustrate a takeaway position 214 of the arcuate path 16 for the forward incline perpendicular alignment 220. After the starting position 182, the golf player 12 positions the golf club 14 into the takeaway position 214 of the back swing 186. At the takeaway position 214 the golf player 12 should be able to view the third color 90 or the red color of the exterior edge 80 and a mininscle portion the second color 82, green color 88. Furthermore, the golf player 12 should not be able to view the first color 82 or yellow color 84. With only the third color 90 and a mininscle portion of the second color 82 exposed to the golf player 12 at the takeaway position 214 assures the face surface 26 will be aligned in the forward incline perpendicular alignment 220 with the golf club 18 at the starting position 182. The golf trainer 62 may also utilized the golf training device 10 for instructing the golf player 12 for positioning the face surface 26 in the forward incline perpendicular alignment 220 with the golf ball 18 at the starting position 182.

Plate Views for Takeaway Position (Forward Incline Perpendicular Alignment)

Player:
Third color 90 or red color 92;
Mininscle portion of second color 86, green color 88;
No vision of the first color 82 or yellow color 84.

Trainer Face-to-Face:
Third color 90 or red color 92;
Mininscle portion of second color 86, green color 88;
No vision of the first color 82 or yellow color 84.

Trainer Front Side:
First color 82 or yellow color 84;
Mininscle portion of third color 90 or red color 92;
No vision of second color 86, green color 88.

Trainer Rear Side:
Second color 86 or green color 88;
Mininscle portion of third color 90 or red color 92;
No vision of first color 82, yellow color 84.

FIGS. 46 and 47, illustrate a follow through position 204 of the arcuate path 16 for the forward incline perpendicular alignment 220. After the takeaway position 214, the golf player 12 positions the golf club 14 into the follow through position 204 of the follow through 206. At the follow through position 204 the golf player 12 should be able to view the third color 90 or the red color of the exterior edge 80 and mininscle portion of the second color 86, green color 88. Furthermore, the golf player 12 should not be able to view the first color 82 or yellow color 84. With only the third color 90 and a mininscle portion of the second color 86 exposed to the golf player 12 at the takeaway position 214 assures the face surface 26 was aligned in the forward incline perpendicular alignment 220 with the golf club 18 at the starting position 182. The golf trainer 62 may also utilized the golf training device 10 for instructing the golf player 12 for positioning the face surface 26 in the forward incline perpendicular alignment 220 with the golf ball 18 at the starting position 182.

Plate Views for Takeaway Position (Forward Incline Perpendicular Alignment)

Player:
Third color 90 or red color 92;
Mininscle portion of second color 86, green color 88;
No vision of the first color 82 or yellow color 84.

Trainer Face-to-Face:
Third color 90 or red color 92;
Mininscle portion of second color 86, green color 88;
No vision of the first color 82 or yellow color 84.

Trainer Front Side:
First color 82 or yellow color 84;
Mininscle portion of third color 90 or red color 92;
No vision of second color 86, green color 88.

Trainer Rear Side:
Second color 86 or green color 88;
Mininscle portion of third color 90 or red color 92;
No vision of first color 82, yellow color 84.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A golf training device for assisting a golf player in aligning a golf club through an arcuate path for contacting a golf ball, the golf club having a shaft interposed between a head and a grip, the head having a face surface for contacting the golf ball, the golf training device, comprising:

a plate including a face side and a back side;

said plate having a thickness for defining an interior edge and an exterior edge;

said face side of said plate having a first color;

said back side of said plate having a second color;

said exterior edge of said plate having a third color;

a coupler extending between said interior edge of said plate and the shaft of the golf club for securing said plate to the golf club;

said plate aligning parallel to the face surface of the golf club;

said third color visible during the golf player swinging the golf club through the arcuate path for producing a perpendicular alignment between the face surface of the golf club and the golf ball;

said first color and said second color not visible during the golf player swinging the golf club through the arcuate path for producing said perpendicular alignment between the face surface of the golf club and the golf ball; and said perpendicular alignment between the face surface of the golf club and the golf ball propelling the golf ball in a straight trajectory.

2. A golf training device for a golf player as set forth in claim 1, wherein said plate defines a trapezoid shape.

3. A golf training device for a golf player as set forth in claim 1, wherein said interior edge of said plate defining an interior trapezoid base having an interior base length;

said exterior edge of said plate defining an exterior trapezoid base having an exterior base length;

said interior trapezoid base and said exterior trapezoid base being in a parallel orientation;

said plate defining an upper trapezoid leg having an upper leg length;

said plate defining a lower trapezoid leg having an lower leg length;

said upper trapezoid leg and said lower leg trapezoid being in a non-parallel orientation;

said interior trapezoid base, said exterior trapezoid base, said upper trapezoid leg and said lower trapezoid leg defining a trapezoid shape;

said interior trapezoid base and said upper trapezoid leg defining an upper acute angle;

said interior trapezoid base and said lower leg trapezoid defining a lower acute angle;

said upper acute angle greater than said lower acute angle and said interior base length greater than said exterior base length for positioning said upper trapezoid leg in a more horizontal orientation than said lower trapezoid leg; and said upper trapezoid leg including said third color.

4. A golf training device for a golf player as set forth in claim 1, wherein said first color includes yellow, said second color includes green and said third color includes red.

5. A golf training device for a golf player as set forth in claim 1, wherein said coupler including an upper clip and a lower clip;

said upper clip having a shaft clamp oppositely opposing a plate clamp;

said shaft clamp of said upper clip including a first arm and a second arm for defining an upper shaft chamber;

said first arm and said second arm of said upper clip yielding for positioning said shaft into upper shaft chamber;

said plate clamp of said upper clip including a primary arm and a secondary arm for defining an upper plate chamber;

said primary arm and secondary arm of said upper clip yielding for positioning said plate into upper plate chamber;

said lower clip having a shaft clamp oppositely opposing a plate clamp;

said shaft clamp of said lower clip including a first arm and a second arm for defining a lower shaft chamber;

said first arm and said second arm of said lower clip yielding for positioning said shaft into lower shaft chamber;

said plate clamp of said lower clip including a primary arm and a secondary arm for defining a lower plate chamber; and said primary arm and secondary arm of said lower clip yielding for positioning said plate into lower plate chamber.

6. A golf training device for a golf player as set forth in claim 1, wherein said first color and said third color visible during the golf player swinging the golf club through the arcuate path for producing an open non-perpendicular alignment between the face surface of the golf club and the golf ball;

said second color not visible during the golf player swinging the golf club through the arcuate path for producing said open non-perpendicular alignment between the face surface of the golf club and the golf ball; and said open non-perpendicular alignment between the face surface of the golf club and the golf ball propelling the golf ball in a left to right curving trajectory.

7. A golf training device for a golf player as set forth in claim 1, wherein said second color and said third color visible during the golf player swinging the golf club through the arcuate path for producing a closed non-perpendicular alignment between the face surface of the golf club and the ball;

said first color not visible during the golf player swinging the golf club through the arcuate path for producing said closed non-perpendicular alignment between the face surface of the golf club and the golf ball; and said closed non-perpendicular alignment between the face surface of the golf club and the golf ball propelling the golf ball in a right to left curving trajectory.

8. A golf training device for a golf player as set forth in claim 1, wherein said first color partially visible during the golf player swinging the golf club through the arcuate path for producing a rear incline perpendicular alignment between the face surface of the golf club and the golf ball;

said second color and said third color not visible during the golf player swinging the golf club through the arcuate path for producing said rear incline perpendicular alignment between the face surface of the golf club and the golf ball; and said rear incline perpendicular alignment between the face surface of the golf club and the golf ball propelling the golf ball in a straight trajectory with the golf ball having a reverse rotation.

9. A golf training device for a golf player as set forth in claim 1, wherein said second color partially visible during the golf player swinging the golf club through the arcuate path for producing a forward incline perpendicular alignment between the face surface of the golf club and the ball;

said first color and said third color visible not visible during the golf player swinging the golf club through the arcuate path for producing said forward incline perpendicular alignment between the face surface of the golf club and the golf ball; and said forward incline perpendicular alignment between the face surface of the golf club and the golf ball propelling the golf ball in a straight trajectory with the golf ball having a forward rotation.

10. A golf training device for assisting a golf trainer in instructing a golf player to align a golf club through an arcuate path for contacting a golf ball, the golf trainer aligning in a face to face orientation with the golf player, the golf club having a shaft interposed between a head and a grip, the head having a face surface for contacting the golf ball, the golf training device, comprising:

a plate including a face side and a back side;

said plate having a thickness for defining an interior edge and an exterior edge;

said face side of said plate having a first color;

said back side of said plate having a second color;

said exterior edge of said plate having a third color;

a coupler extending between said interior edge of said plate and the shaft of the golf club for securing said plate to the golf club;

said plate aligning parallel to the face surface of the golf club;

said third color visible to the golf trainer with the golf club in a vertical position of the arcuate path for producing a perpendicular alignment between the face surface of the golf club and the golf ball;

said first color and said second color not visible to the golf trainer with the golf club in said vertical position of the arcuate path for producing said perpendicular alignment between the face surface of the golf club and the golf ball; and said perpendicular alignment between the face surface of the golf club and the golf ball propelling the golf ball in a straight trajectory.

11. A golf training device for assisting a golf trainer as set forth in claim 10, wherein said first color visible to the golf trainer with the golf club in a rear horizontal position of the arcuate path for indicating said perpendicular alignment between the face surface of the golf club and the ball; and said second color and said third color not visible to the golf trainer with the golf club in said rear horizontal position of the arcuate path for indicating said perpendicular alignment between the face surface of the golf club and the golf ball.

12. A golf training device for assisting a golf trainer as set forth in claim 10, wherein said second color visible to the golf trainer with the golf club in a forward horizontal position of the arcuate path for indicating said perpendicular alignment between the face surface of the golf club and the ball; and said first color and said third color not visible to the golf trainer with the golf club in said forward horizontal position of the arcuate path for indicating said perpendicular alignment between the face surface of the golf club and the golf ball.

13. A process for training a golf player in aligning a golf club through an arcuate path for contacting a golf ball, the golf club having a shaft interposed between a head and a grip, the head having a face surface for contacting the golf ball, a plate having a face side and a back side, the plate having a thickness for defining an interior edge and an exterior edge, the face side of the plate having a first color, the back side of the plate having a second color, the exterior edge of the plate having a third color, a coupler extending between the interior edge of the plate and the shaft of the golf club for securing the plate to the golf club, the plate aligning parallel to the face surface of the golf club, the process comprising the steps of:

aligning the plate for viewing the third color during the golf player swinging the golf club through the arcuate path for producing a perpendicular alignment between the face surface of the golf club and the golf ball;

aligning the plate for not viewing the first color and the second color during the golf player swinging the golf club through the arcuate path for producing said perpendicular alignment between the face surface of the golf club and the golf ball; and striking the golf ball with the face surface of the golf club with said perpendicular alignment between the face surface of the golf club and the golf ball for propelling the golf ball in a straight trajectory.

14. A process for a golf trainer to assist a golf player in aligning a golf club through an arcuate path for contacting a golf ball as set forth in claim 13, further including the step of:

aligning the plate for viewing the first color and the third color during the golf player swinging the golf club through the arcuate path for producing a open non-perpendicular alignment between the face surface of the golf club and the golf ball;

aligning the plate for not viewing the second color during the golf player swinging the golf club through the arcuate path for producing said open non-perpendicular alignment between the face surface of the golf club and the golf ball; and striking the golf ball with the face surface of the golf club with said open non-perpendicular alignment between the face surface of the golf club and the golf ball for propelling the golf ball in a in a left to right curving trajectory.

15. A process for a golf trainer to assist a golf player in aligning a golf club through an arcuate path for contacting a golf ball as set forth in claim 13, further including the step of:

aligning the plate for viewing the second color and the third color during the golf player swinging the golf club through the arcuate path for producing a closed non-perpendicular alignment between the face surface of the golf club and the golf ball;

aligning the plate for not viewing the first color during the golf player swinging the golf club through the arcuate path for producing said closed non-perpendicular alignment between the face surface of the golf club and the golf ball; and striking the golf ball with the face surface of the golf club with said closed non-perpendicular alignment between the face surface of the golf club and the golf ball for propelling the golf ball in a right to left curving trajectory.

16. A process for a golf trainer to assist a golf player in aligning a golf club through an arcuate path for contacting a golf ball as set forth in claim 13, further including the step of:

aligning the plate for partially viewing the first color during the golf player swinging the golf club through the arcuate path for producing a rear incline perpendicular alignment between the face surface of the golf club and the golf ball;

aligning the plate for not viewing the second color and the third color during the golf player swinging the golf club through the arcuate path for producing said rear incline perpendicular alignment between the face surface of the golf club and the golf ball; and striking the golf ball with the face surface of the golf club with said rear incline perpendicular alignment between the face surface of the golf club and the golf ball for propelling the golf ball in a straight trajectory with the golf ball having a reverse rotation.

17. A process for a golf trainer to assist a golf player in aligning a golf club through an arcuate path for contacting a golf ball as set forth in claim 13, further including the step of:

aligning the plate for partially viewing the second color during the golf player swinging the golf club through the arcuate path for producing a forward incline perpendicular alignment between the face surface of the golf club and the golf ball;

aligning the plate for not viewing the first color and the third color during the golf player swinging the golf club through the arcuate path for producing said forward incline perpendicular alignment between the face surface of the golf club and the golf ball; and striking the golf ball with the face surface of the golf club with said forward incline perpendicular alignment between the face surface of the golf club and the golf ball for propelling the golf ball in a straight trajectory with the golf ball having a forward rotation.

18. A process for a golf trainer to assist a golf player in aligning a golf club through an arcuate path for contacting a golf ball, the golf trainer aligning in a face to face orientation with the golf player, the golf club having a shaft interposed between a head and a grip, the head having a face surface for contacting the golf ball, a plate having a face side and a back side, the plate having a thickness for defining an interior edge and an exterior edge, the face side of the plate having a first color, the back side of the plate having a second color, the exterior edge of the plate having a third color, a coupler extending between the interior edge of the plate and the shaft of the golf club for securing the plate to the golf club, the plate aligning parallel to the face surface of the golf club, the process comprising the steps of:

aligning the plate for viewing the third color by the golf trainer during the golf club in a vertical position of the arcuate path for producing a perpendicular alignment between the face surface of the golf club and the golf ball;

aligning the plate for not viewing the first color and the second color by the golf trainer during the golf club in said vertical position of the arcuate path for producing said perpendicular alignment between the face surface of the golf club and the golf ball; and striking the golf ball with the face surface of the golf club with said perpendicular alignment between the face surface of the golf club and the golf ball for propelling the golf ball in a straight trajectory.

19. A process for a golf trainer to assist a golf player in aligning a golf club through an arcuate path for contacting a golf ball as set forth in claim 18, further including the step of aligning the plate for viewing the first color by the golf trainer during the golf club in a rear horizontal position of the arcuate path for producing said perpendicular alignment between the face surface of the golf club and the ball; and aligning the plate for not viewing the second color and the third color by the golf trainer during the golf club in said rear horizontal position of the arcuate path for producing said perpendicular alignment between the face surface of the golf club and the golf ball.

20. A process for a golf trainer to assist a golf player in aligning a golf club through an arcuate path for contacting a golf ball as set forth in claim 18, further including the step of aligning the plate for viewing the second color by the golf trainer during the golf club in a forward horizontal position of the arcuate path for producing said perpendicular alignment between the face surface of the golf club and the ball; and aligning the plate for not viewing the first color and the third color by the golf trainer during the golf club in said forward horizontal position of the arcuate path for producing said perpendicular alignment between the face surface of the golf club and the golf ball.

* * * * *